US008562330B2

(12) United States Patent
Irwin

(10) Patent No.: US 8,562,330 B2
(45) Date of Patent: Oct. 22, 2013

(54) RIM ROLLING SCREW HAVING PNEUMATIC COOLING

(76) Inventor: Jere F Irwin, Yakima, WA (US)

( * ) Notice: Subject to any disclaimer, the term of this patent is extended or adjusted under 35 U.S.C. 154(b) by 441 days.

(21) Appl. No.: 12/819,995

(22) Filed: Jun. 21, 2010

(65) Prior Publication Data

US 2010/0319431 A1 Dec. 23, 2010

Related U.S. Application Data

(60) Provisional application No. 61/218,972, filed on Jun. 21, 2009.

(51) Int. Cl.
*B29C 53/84* (2006.01)

(52) U.S. Cl.
USPC ..... 425/384; 425/392

(58) Field of Classification Search
USPC ..... 425/384, 329, 334, 391, 392
See application file for complete search history.

(56) References Cited

U.S. PATENT DOCUMENTS

| | | | | |
|---|---|---|---|---|
| 2,719,324 | A | 10/1955 | Gray et al. | |
| 3,192,565 | A * | 7/1965 | Rukavina | 425/148 |
| 3,337,919 | A | 8/1967 | Brown | |
| 3,339,005 | A * | 8/1967 | Brown et al. | 264/297.5 |
| 3,355,536 | A * | 11/1967 | Midgley et al. | 264/322 |
| 3,358,331 | A * | 12/1967 | Weber | 425/329 |
| 3,363,283 | A * | 1/1968 | Weber | 425/329 |
| 3,548,457 | A * | 12/1970 | Kulig | 425/392 |
| 3,579,737 | A * | 5/1971 | Gerber et al. | 425/193 |
| 3,676,543 | A * | 7/1972 | Gerber et al. | 264/296 |
| 3,768,943 | A | 10/1973 | Maihart | |
| 3,914,102 | A * | 10/1975 | Brown | 425/392 |
| 3,920,373 | A * | 11/1975 | Brown | 425/392 |
| 4,391,768 | A * | 7/1983 | Arends et al. | 264/285 |
| 6,033,214 | A | 3/2000 | Merz | |
| 6,093,010 | A | 7/2000 | Lamson | |
| 6,129,537 | A | 10/2000 | Merz | |
| 6,135,754 | A | 10/2000 | Lamson | |
| 6,164,949 | A | 12/2000 | Lamson | |
| 6,719,552 | B1 | 4/2004 | Golden | |
| 7,052,265 | B2 | 5/2006 | Phillips et al. | |
| 7,175,409 | B1 | 2/2007 | Golden | |
| 7,175,410 | B1 | 2/2007 | Golden | |

* cited by examiner

*Primary Examiner* — Dana Ross
*Assistant Examiner* — Chwen-Wei Su
(74) *Attorney, Agent, or Firm* — Wells St. John P.S.

(57) ABSTRACT

A rim rolling apparatus is provided having a plurality of rim rolling screws, a motor and a pneumatic cooling circuit. Each screw has a hot section and a cool section provided downstream of the hot section. The motor is configured to drive the screws in rotation to feed thermoformed articles between the screws to roll lips of the articles. The pneumatic cooling circuit extends within the screw from an exit end towards an entrance end. The cooling circuit is provided in thermally conductive relation with the cool section and insulated from the hot section.

20 Claims, 22 Drawing Sheets

RIM ROLLING SCREW HAVING PNEUMATIC COOLING

RELATED PATENT DATA

This application claims priority to U.S. Provisional Patent Application Ser. No. 61/218,972 which was filed Jun. 21, 2009, entitled "Rim Rolling Screw Having Pneumatic Cooling", the entirety of which is incorporated by reference herein.

TECHNICAL FIELD

This invention pertains to lip and rim rolling machines. More particularly, the present invention relates to rim rolling machines for forming a curled lip on a thermoformed plastic container.

BACKGROUND OF THE INVENTION

Arrays of rim rolling screws are known. Hot sections are used to heat up a lip edge of a thermoformed article before conveying the lip edge between the array of screws to curl and form a rolled lip edge. Cool sections of screws are used to then capture the curled and formed rolled lip edge. Techniques have been used to provide separate hot sections and cold sections. Techniques have also been used to cool the cool section using a liquid cooling system.

SUMMARY OF THE INVENTION

A rim rolling machine having rim rolling screws with heated hot and cool sections is provided. The hot section is connected to the cool section with a connector that reduces any heat transfer from the hot section to the cool section. Furthermore, a flow of air is delivered through both the cool and hot sections, opposite the direction that cups are delivered along the screws, where air flows along an inner surface of the cool section, but travels through an isolation tube inside the hot section to prevent cooling of this section. The flow of air also serves to cool bearings that support each screw at each end. Furthermore, the rim rolling machine has a mounting mechanism for quickly and easily mounting and removing tubes of a rim roller screw. Finally, the rim rolling machine has a spring, or pneumatic cylinder for applying constant pressure when mounting a tube of a rim roller screw, thereby accommodating changes in length of the tube resulting from oven heating without imparting additional undue lateral compressive loads on a bearing race.

According to one aspect, a rim rolling apparatus is provided having a plurality of rim rolling screws, a motor and a pneumatic cooling circuit. Each screw has a hot section and a cool section provided downstream of the hot section. The motor is configured to drive the screws in rotation to feed thermoformed articles between the screws to roll lips of the articles. The pneumatic cooling circuit extends within the screw from an exit end towards an entrance end. The cooling circuit is provided in thermally conductive relation with the cool section and insulated from the hot section.

While the invention was motivated in addressing rim rolling screws and machines by providing improved and simplified constructions for a rim rolling screw having both hot and cold sections in one screw, it is in no way so limited. The invention is only limited by the accompanying claims as literally worded, without interpretative or other limiting reference to the specification, and in accordance with the doctrine of equivalents. Other aspects and implementations are contemplated.

BRIEF DESCRIPTION OF THE DRAWINGS

Preferred embodiments of the invention are described below with reference to the following accompanying drawings.

FIG. 10 is a component perspective view of a screw exit pulley assembly.

FIG. 17 is an enlarged partial perspective view along an exit end from the rear of the rim rolling machine of FIGS. 1-16 showing portions of the oven cover opening mechanism.

FIG. 19 is an exit end view of a selected tube assembly for a rim roller screw.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
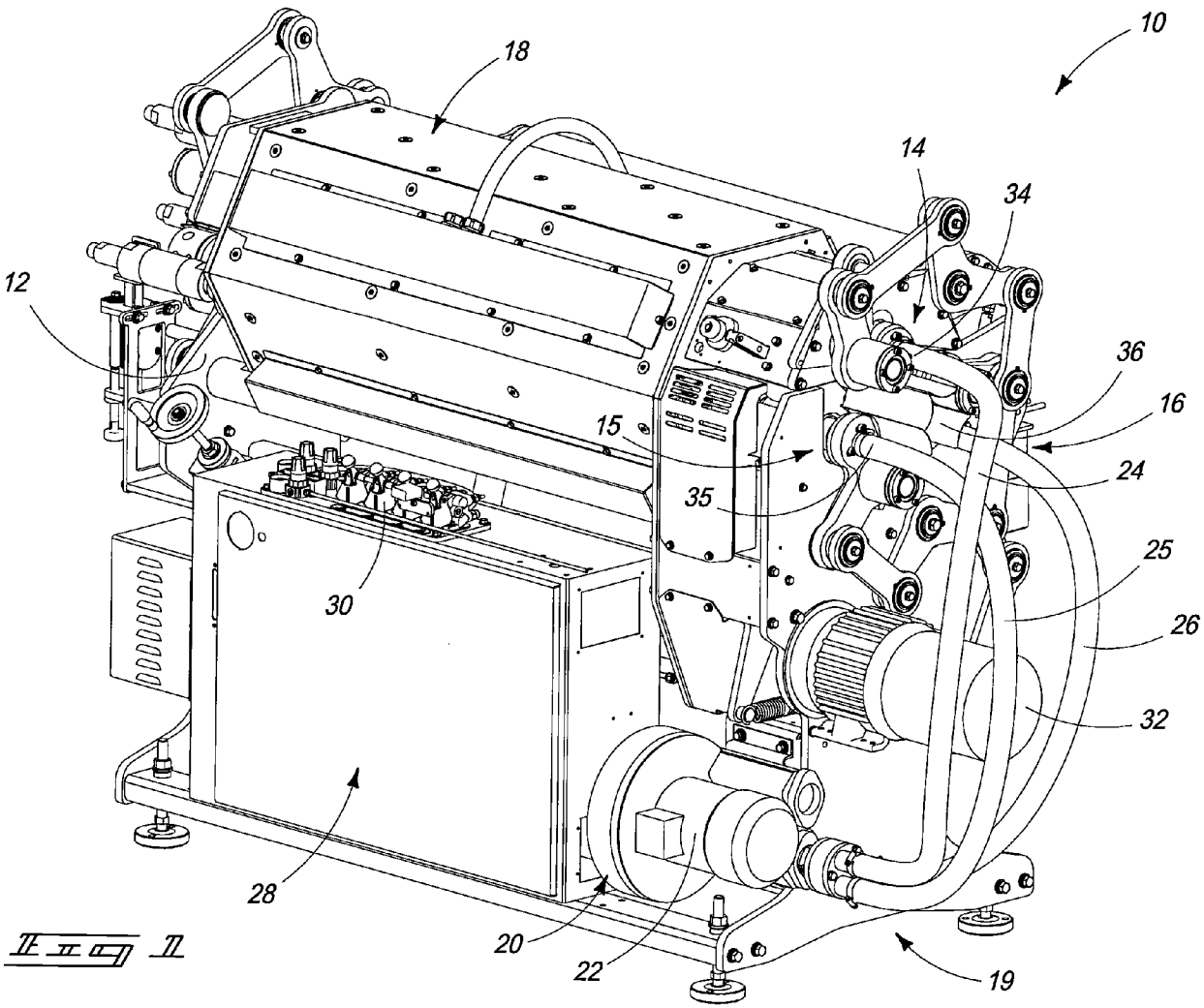
FIG. 1 is an exit end perspective view of a rim rolling machine.

A rim rolling machine 10 is provided for heat forming rolled lip edges on thermoformed articles, such as cups, according to one aspect of the present invention. As shown in FIG. 1, rim rolling machine 10 includes a structural frame 12 comprising an array of side plates and cross members. A plurality of rim roller screws 14-16 are supported by frame 12 so as to be driven in rotation to deliver thermoformed articles through the machine. Additionally or optionally, further rollers can be provided to guide and support articles as they are conveyed between the screws 14-16. An upstream portion of each screw 14-16 is supported within an oven 18 that heats up screws 14-16 so as to provide heat that is used to curl and roll a lip edge on cups that are conveyed between screws 14-16.

A cooling system 19 is provided on machine 10 in order to cool a downstream end of each screw 14-16 in order to provide a mechanism to cool and capture a curled lip edge on individual cups after they have been formed along a heated upstream section of each screw 14-16. More particularly, a pneumatic source of air 20 is provided by a high pressure motor-driven fan 22 to deliver a flow of air via individual tubes 24-26 to an inlet on each rim roller screw 14-16, respectively.

A control system box 28 is supported by frame 12 for containing electrical and pneumatic controls 30. An electrical screw drive motor 32 is also supported by frame 12 to drive rim roller screws 14-16 in rotation using the drive belt system described below with reference to FIG. 11.

Figure 2:
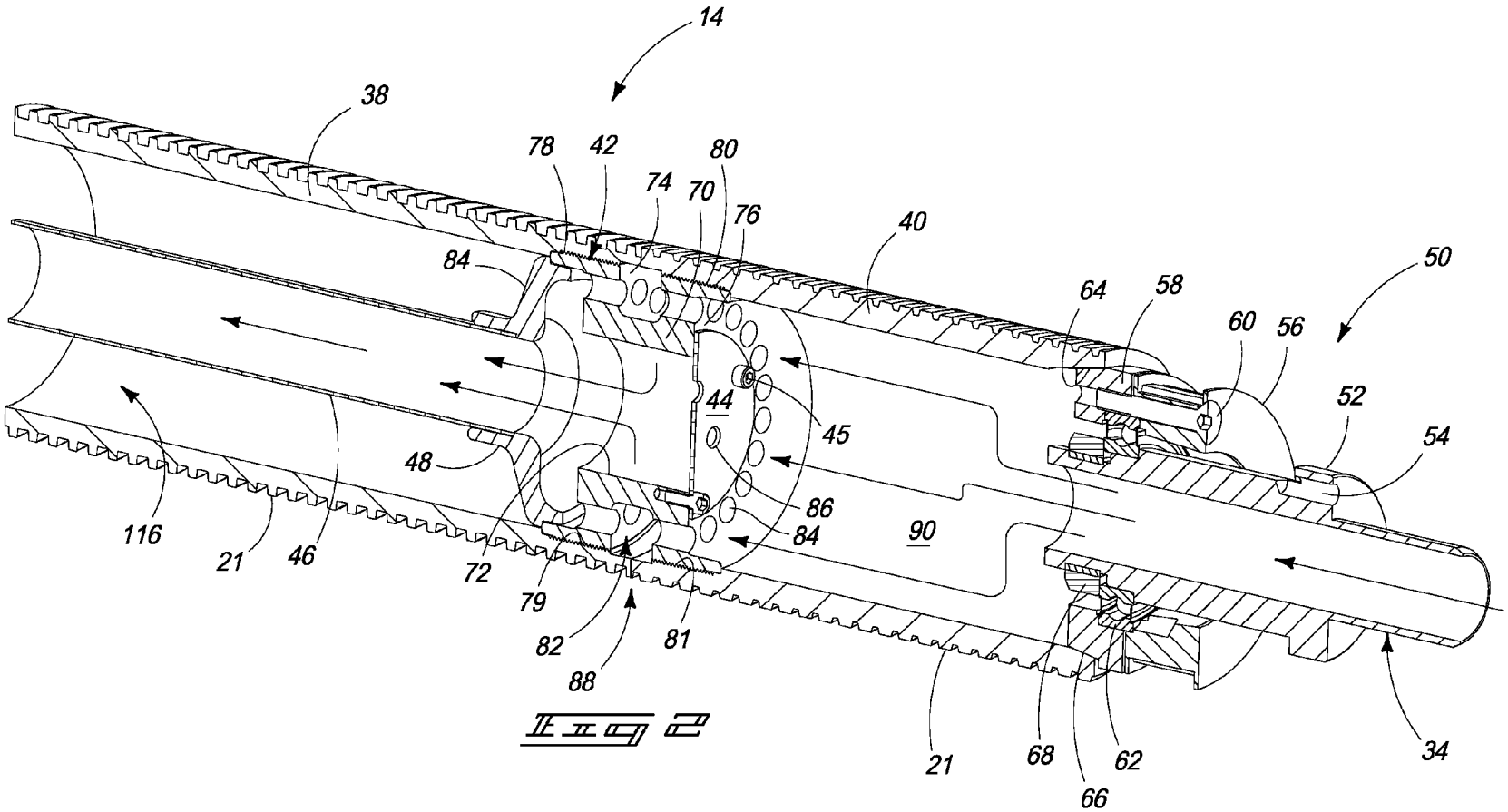
FIG. 2 is a vertical sectional perspective view of an exit end of one rim roller screw from the rim rolling machine of FIG. 1.
Figure 3:
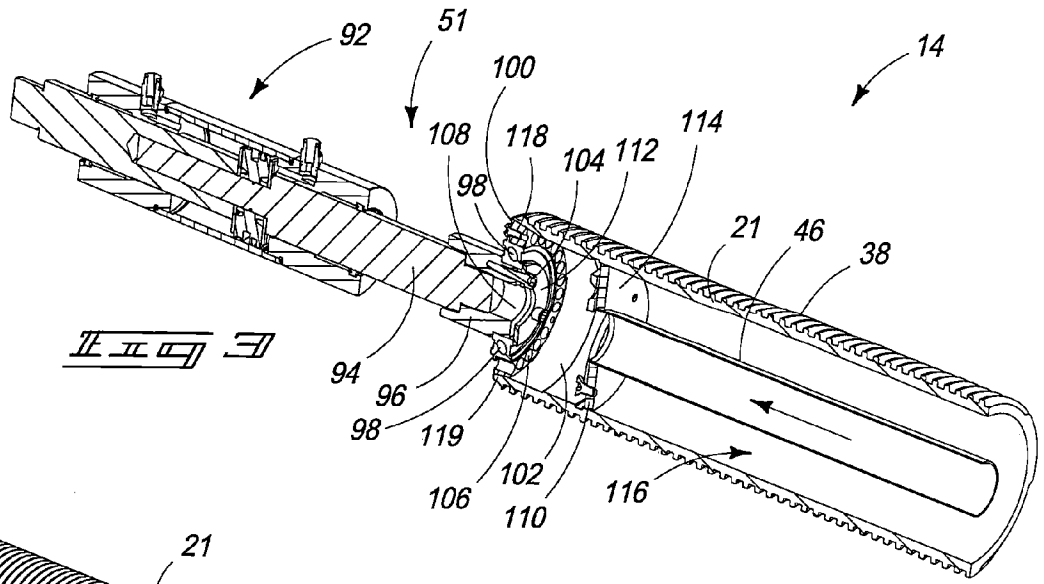
FIG. 3 is a vertical sectional perspective view of an entrance end of the rim roller screw of FIG. 2.
Figure 3A:
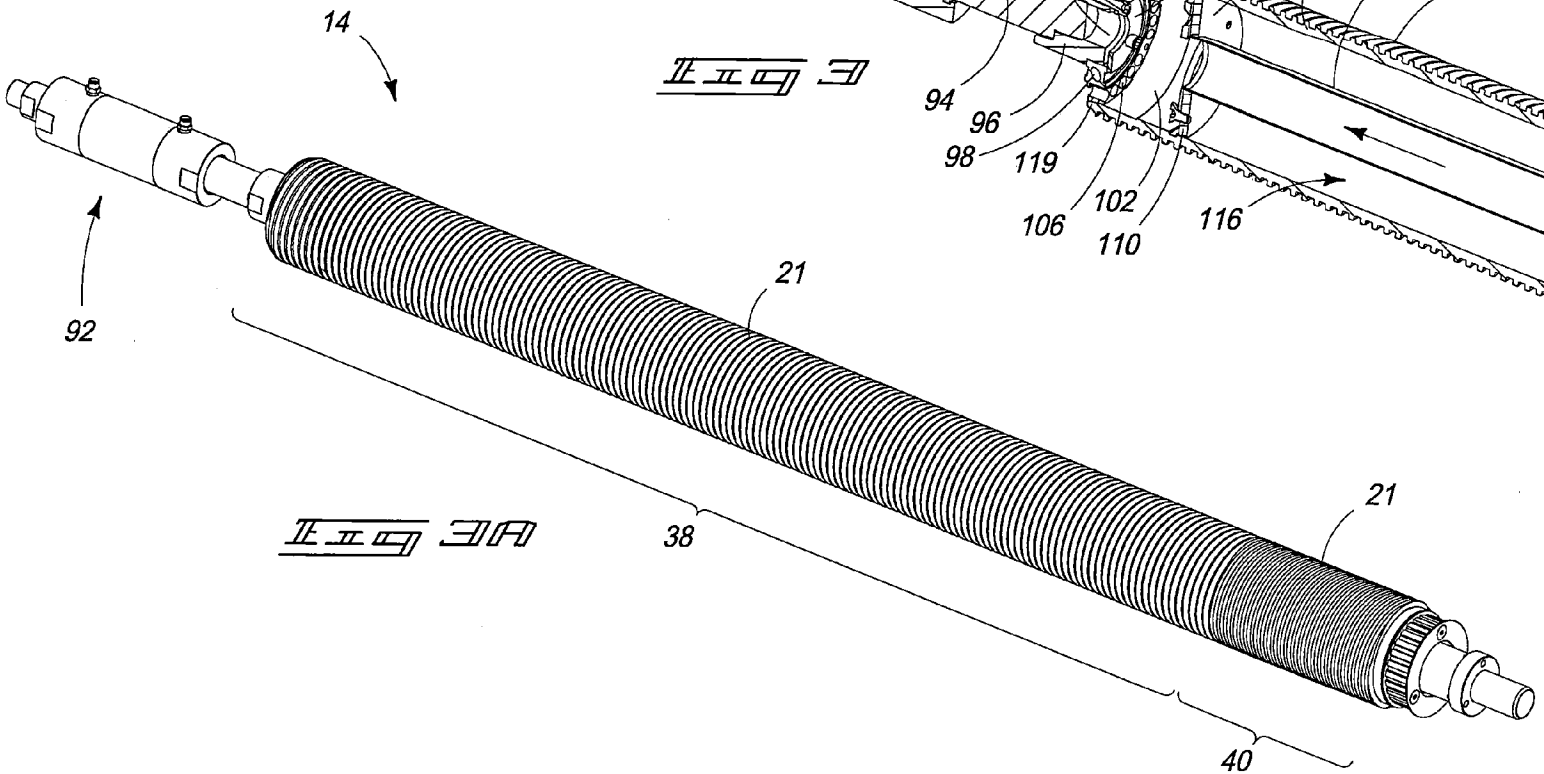
FIG. 3A is a perspective view of the rim roller screw of FIGS. 2-3.

FIGS. 2 and 3 illustrate construction of rim roller screw 14. Screws 15 and 16 are similarly constructed. More particularly, rim roller screw 14 includes an entrance end cylindrical tube 38, an exit end cylindrical tube 40, and a heat isolating connector 42 that joins together tubes 38 and 40, as shown in FIG. 3. A helical groove 21 is provided in the outer surface of screw 14 according to known techniques to progressively form a rolled rim on a cup that is conveyed between the rotating screws 14-16. According to one construction, tubes 38 and 40 are formed from aluminum tube and connector 42 is formed from steel. Other materials and constructions can be used.

Connector 42 joins together tubes 38 and 40 while also thermally isolating tubes 38 and 40 from one another. More particularly, tube 38 is heated up within oven 18 (see FIG. 1) via radiant oven heating elements 120 (see FIG. 8). A heated outer surface on tube 38 heats up a cup lip via groove 21, thereby softening up the lip and enabling progressive advance of the lip along the groove to shape and roll the lip. Once formed, the rolled lip is cooled by contact within groove 21 around tube 40, as tube 40 is cooled by a flow of pneumatic fluid (air) that is delivered there through. Connector 42 is constructed in a manner that reduces heat transfer from tube 38 to tube 40. Likewise, connector 42 reduces transmission of cold from tube 40 to tube 38.

As shown in FIG. 2, connector 42 includes a cylindrical central hub 70 that defines a cylindrical inner bore 72. A pair of axially spaced-apart circumferential bulkheads 74 and 76 extend outwardly of hub 70 in a radial direction. Each bulkhead terminates in a threaded cylindrical outer surface 78 and 80, respectively. Threaded surfaces 78 and 80 mate in assembly with complementary threaded cylindrical inner surfaces 79 and 81 in tubes 38 and 40, respectively. Threaded portions 79 and 81 are limited in length to ensure that a circumferential gap 88 is provided between tubes 38 and 40, thereby preventing heat transmission through any direct contact from tube 38 into tube 40. A circumferential gap 82 is provided between bulkheads 74 and 76. A baffle plate 44 is secured with three fasteners 45 onto connector 42 to cover bore 72 and limit how much air flows through plate 44 so that more air is directed through bores 84. A plurality of bores, or apertures 86 allow some air to flow through bore 72. A circumferential array of bores 84 along a radial outer portion of each bulkhead 74 and 76 provides a path for air, or pneumatic fluid to pass through connector 42. Apertures 84 ensure a flow of cooling air along an inner surface 90 of tube 40 that is delivered from inlet member 34.

In order to prevent cooling of tube 38, a flow isolation tube 46 is supported coaxially within tube 38 as shown in FIG. 2. Tube 46 is supported at an upstream end, adjacent connector 42, within a frustoconical flange 48. Tube 46 is supported at a downstream end via a cylindrical end plate 114 (see FIG. 3). Flange 48 and end plate 114 are welded onto opposite ends of tube 46. Optionally, they can be press fit or glued together.

Flow isolation tube 46 is retained inside of tube 38 by flange 48 and end plate 114, which fit smoothly inside of tube 38, as shown in FIGS. 2 and 3. Connector 42 retains flange 48 at one end, while a C-shaped spring clip 110 traps an opposite end of tube 38 by being placed into a circumferential groove 112 on an inner surface of tube 48. In this way, C-shaped spring clip 110 can be removed using a tool in order to insert and remove tube 46 within tube 38. According to one construction, tube 46, flange 48 and end plate 114 are made from stainless steel. Optionally, they can be made from steel, aluminum, copper, or any other suitable structural material. Further optionally, an insulating material can be used or added to an inner or outer surface.

Figure 12:
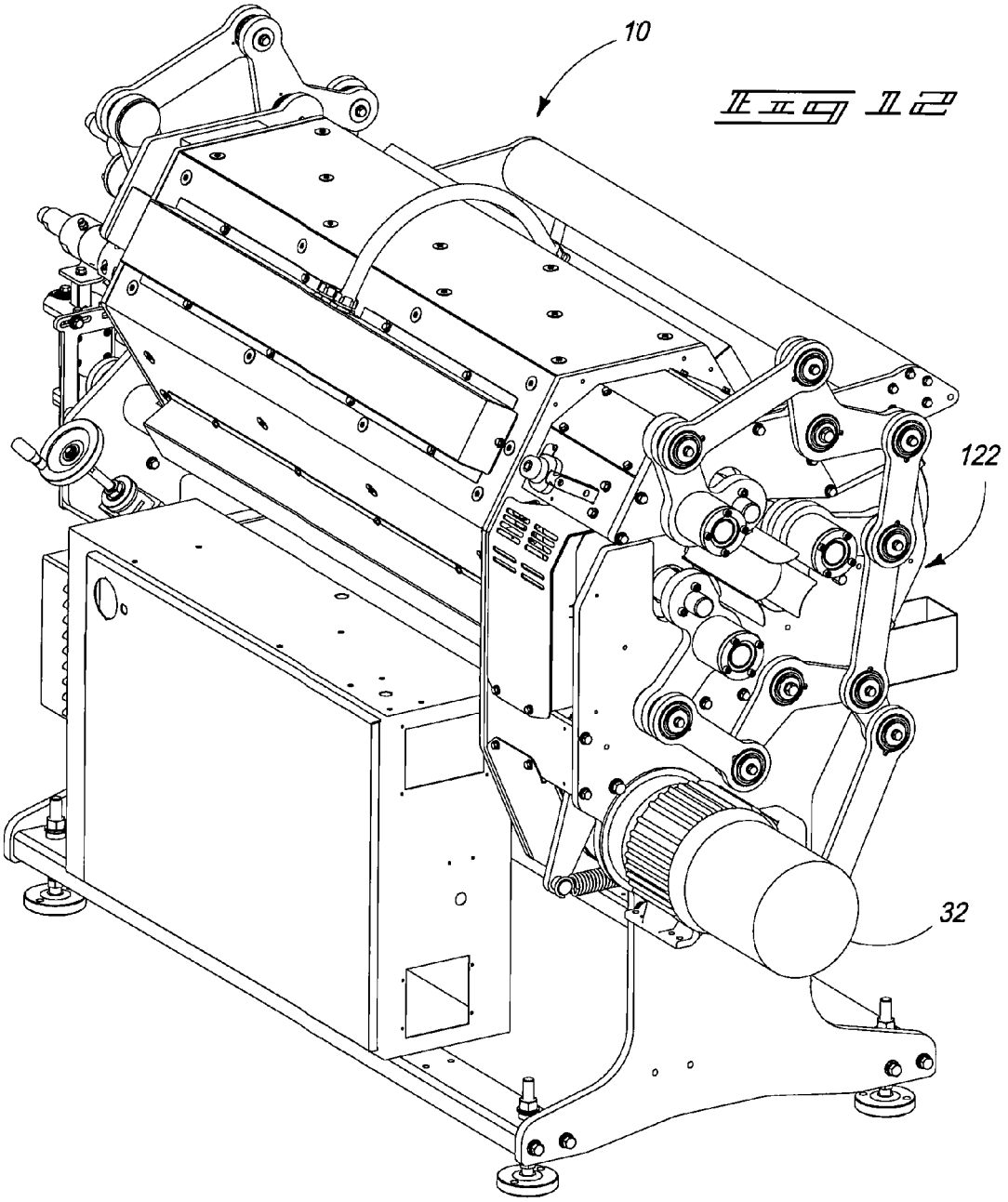
FIG. 12 is an exit end perspective view, taken from the front, corresponding with that depicted in FIG. 1, with portions removed, showing a radial adjustment mechanism for radially adjusting position of the three rim roller screws.
Figure 13:
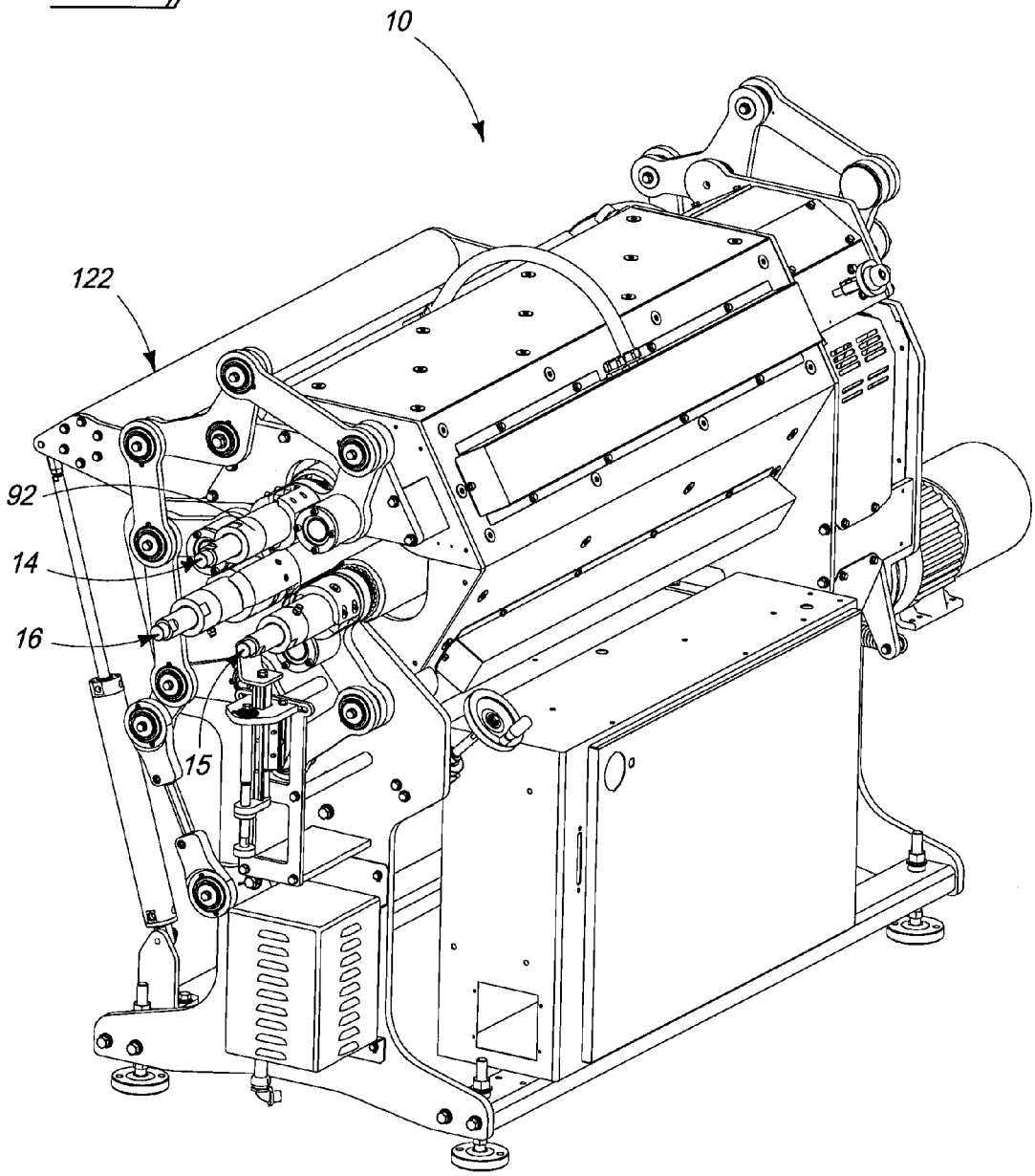
FIG. 13 is an exit end perspective view, taken from the rear, with portions removed, showing the radial adjustment mechanism of FIGS. 12-12A.

An exit end plate 58 is provided at an exit of screw 14 as shown in FIG. 2. End plate 58 is secured to a belt drive pulley 56 with a plurality of threaded fasteners 60. A drive assembly 50 is provided by end plate 58, pulley 56, and inlet member 34. A cylindrical bearing 62 supports pulley 56 and end plate 58 for rotation about inlet member 34. A flange 52 on member 34 is secured to a support bracket, or frame member with a plurality of threaded fasteners (not shown) that pass through hole 54 to support an end of screw 14. Such bracket is adjustable in radial position in order to adjust for different sized thermoformed articles, as is already understood according to numerous techniques in the art. Further details of one construction are shown in FIGS. 12-13.

A nut (or a snap ring) 68 is used to trap an inner race of bearing 62 onto member 34. An outer race of bearing 62 is trapped between pulley 56 and end plate 58 using a circumferential array of threaded fasteners.

An end plate 100 is provided at the entrance of screw 14 (see FIG. 3), or downstream end of the pneumatic cooling fluid, for cooling a cylindrical bearing 98. Cylindrical bearing 62 (see FIG. 2) is provided at the opposite end of screw 14 and is cooled by inlet member 34 as air flows through member 34. A cylindrical array of bores 106 are provided along an outer cylindrical periphery of end plate 100 in order to enable the flow of cooling air that leaves tube 46 to exit tube 14. The flow of air through bores 106 of plate 100 cools plate 100, thereby cooling bearing 98.

A pneumatic cylinder 92 is provided at the entrance end of each screw, such as screw 14 of FIG. 3. Cylinder 92 facilitates quick mounting and demounting of screws 14 from a machine. More particularly, entrance end of screw 14 provides a tapering circumferential bevel 118 on tube 38 and a complementary tapering circumferential bevel 119 on end plate 100 (see FIG. 3). In addition, exit end of screw 14 provides a tapering circumferential bevel 64 on tube 40 and a complementary tapering circumferential bevel 66 on a drive lug, or end plate 58 (see FIG. 2). By retracting cylinder 92 (of FIG. 3), screw 14 can be removed (with the oven open) as the pairs of mating bevels separate, allowing withdrawal of tubes 38, 40 and connector 42. By extending cylinder 92 after inserting a new screw 14, the screw 14 is trapped or mated between end plates 58 and 100 (see FIGS. 2 and 3). A boss 96 is seated on piston 94 and traps an inner race of bearing 98 in cooperation with washer plate 102. Washer plate 102 is mounted with three threaded fasteners 104 onto boss 96.

Figure 4:
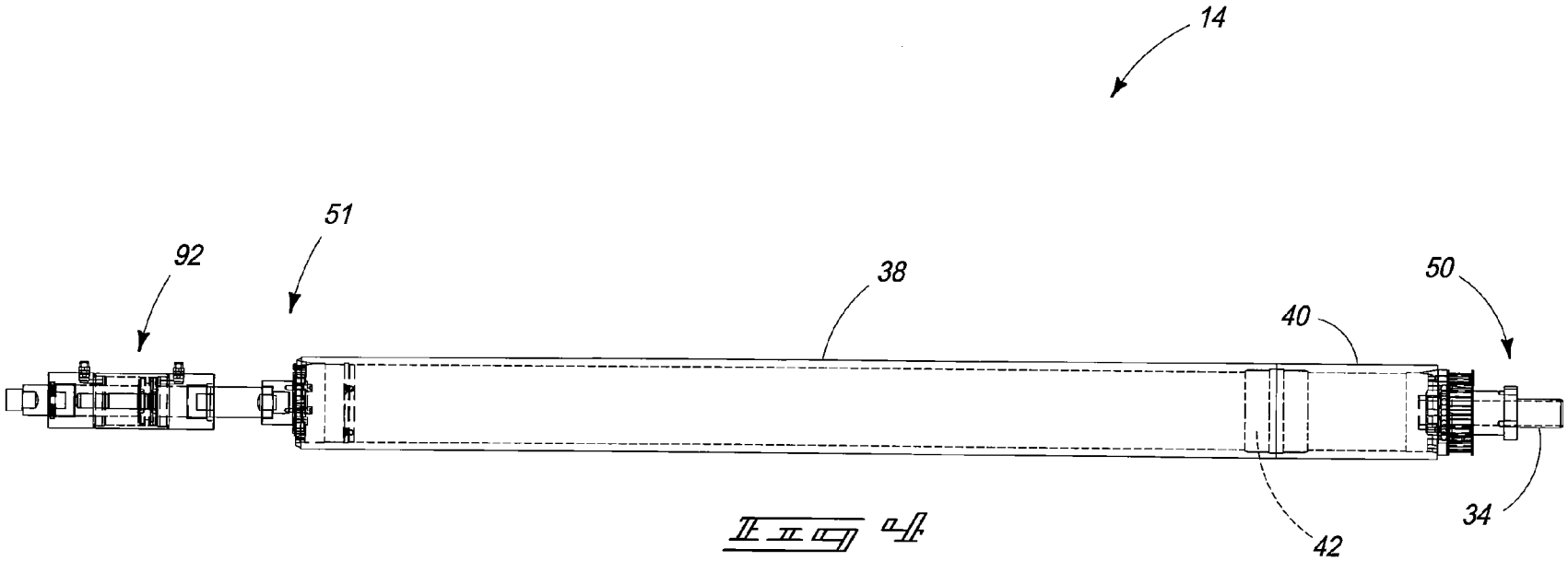
FIG. 4 is a vertical side view of the rim roller screw of FIGS. 2-3.

FIG. 4 is a vertical side view of the rim roller screw 14 of FIGS. 2-3. The pneumatic cylinder, or piston 52, drive assembly 50, bearing assembly 51, tubes 38 and 40, and connector 42 are illustrated in assembly.

Figure 5A:
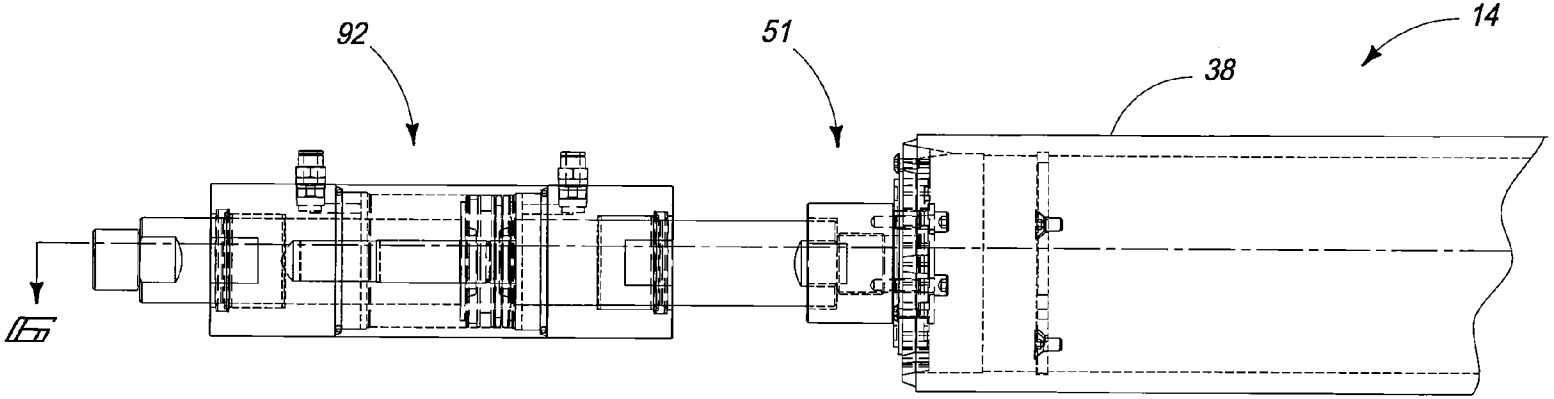
FIG. 5A is an enlarged partial breakaway side view of the downstream, entrance end of the rim roller screw of FIG. 4.

FIG. 5A is an enlarged partial breakaway side view of the downstream, entrance end of the rim roller screw of FIG. 4. The arrangement of pneumatic cylinder 92, bearing assembly 51 and tube 38 are shown.

Figure 5B:
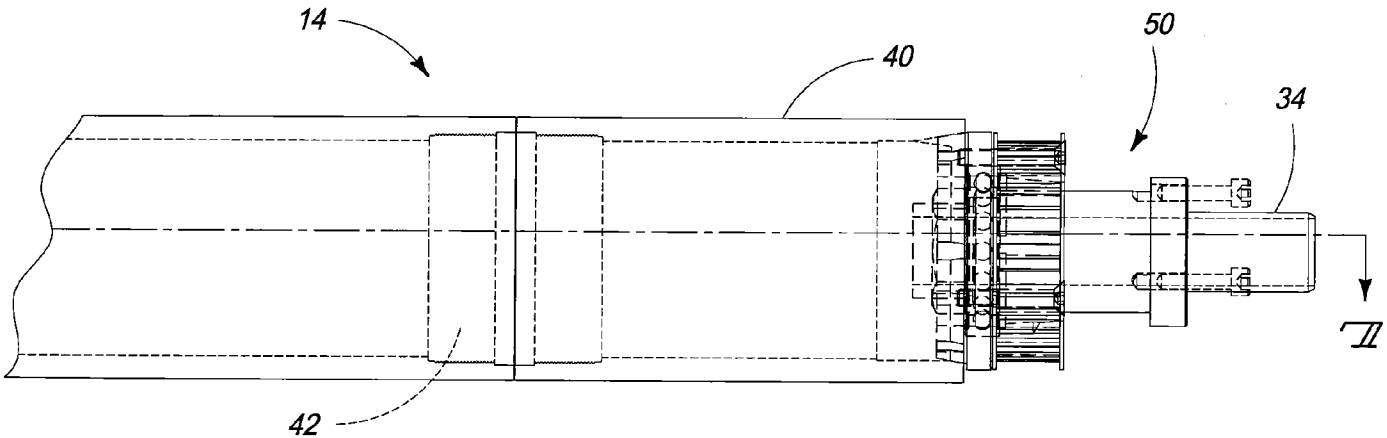
FIG. 5B is an enlarged partial breakaway side view of the upstream, exit end of the rim roller screw of FIG. 4.

FIG. 5B is an enlarged partial breakaway side view of the upstream, exit end of the rim roller screw of FIG. 4. The arrangement of connector 42 and drive assembly 50 are shown in relation to tube 40.

Figure 6A:
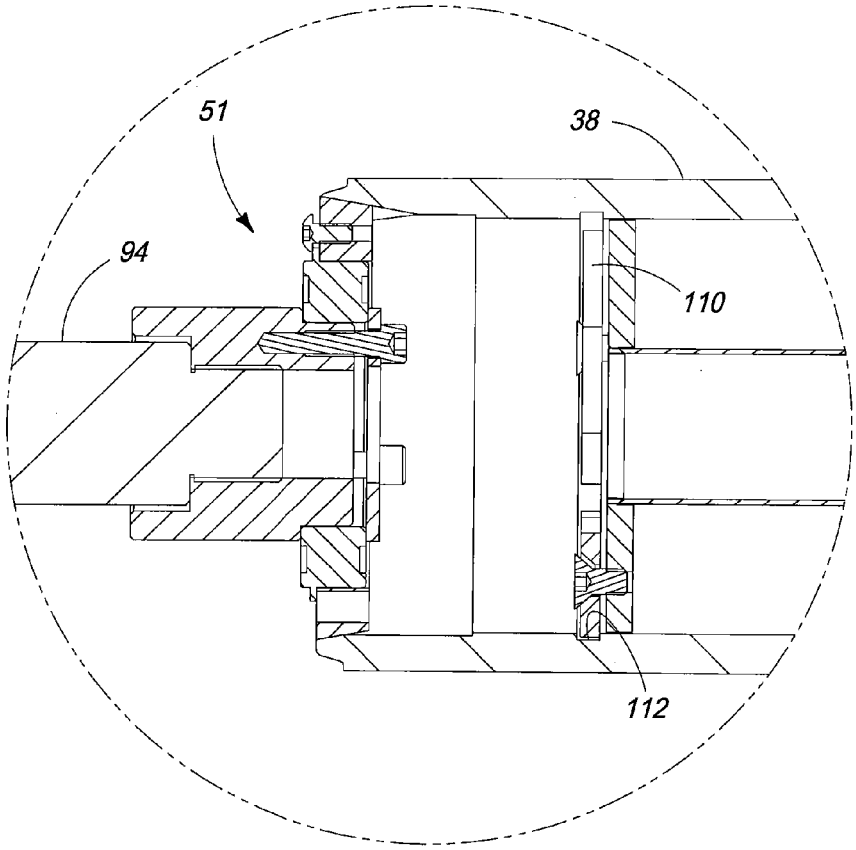
FIG. 6A is an enlarged view taken from encircled region 6A of FIG. 6.
Figure 6:
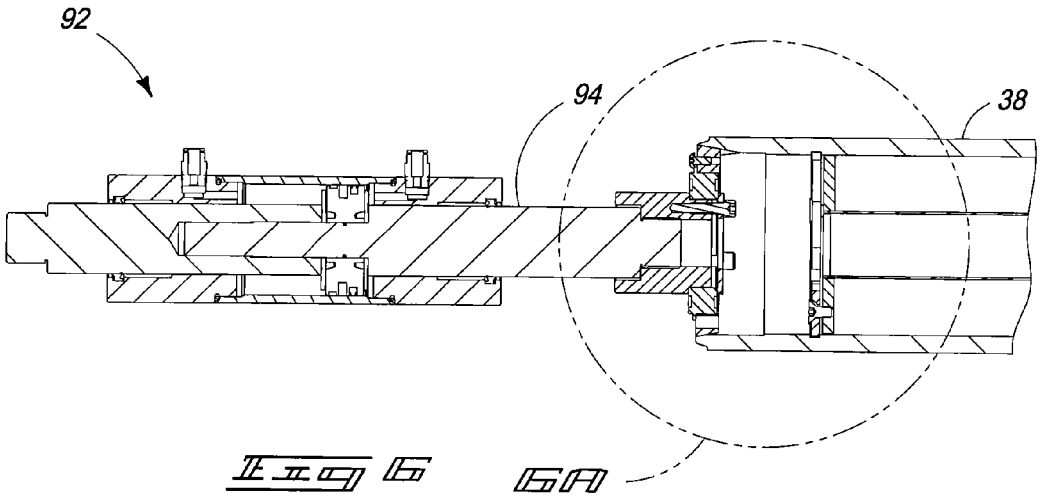
FIG. 6 is centerline sectional view taken along arrow 6 of FIG. 5A.

FIG. 6 is a centerline sectional view taken along arrow 6 of FIG. 5A. Connection of pneumatic cylinder 92 with tube 38 is shown.

FIG. 6A is an enlarged view taken from encircled region 6A of FIG. 6. C-shaped spring clip 110 is shown positioned within groove 112.

Figure 7A:
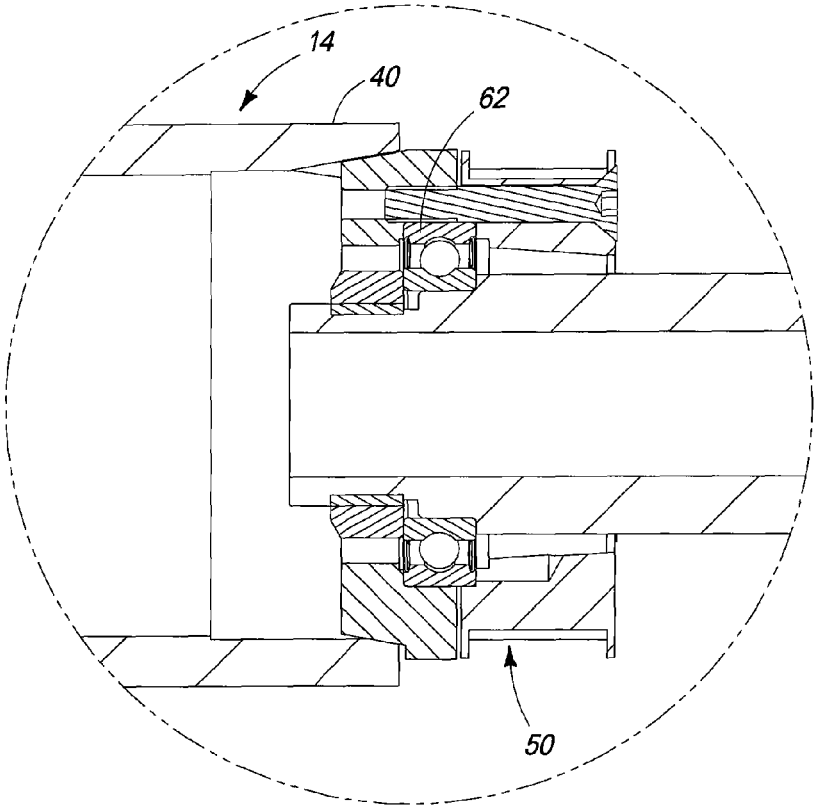
FIG. 7A is an enlarged view taken from encircled region 7A of FIG. 7.
Figure 7:
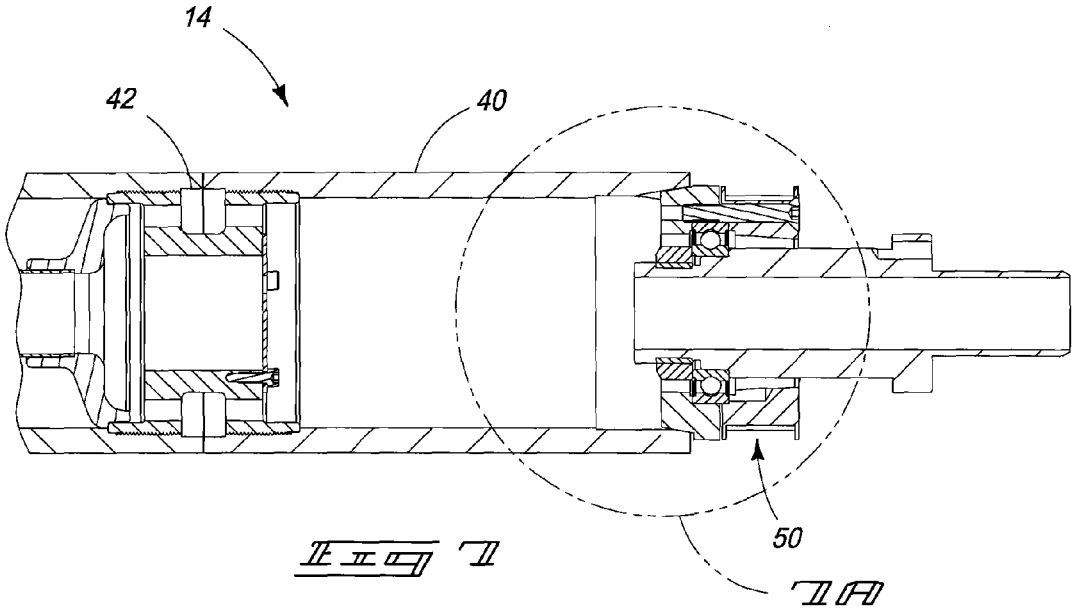
FIG. 7 is a centerline sectional view taken along arrow 7 of FIG. 5B.

FIG. 7 is a centerline sectional view taken along arrow 7 of FIG. 5B. Arrangement of connector 42 is shown.

FIG. 7A is an enlarged view taken from encircled region 7A of FIG. 7. Positioning of cylindrical bearing 62 is shown.

Figure 8:
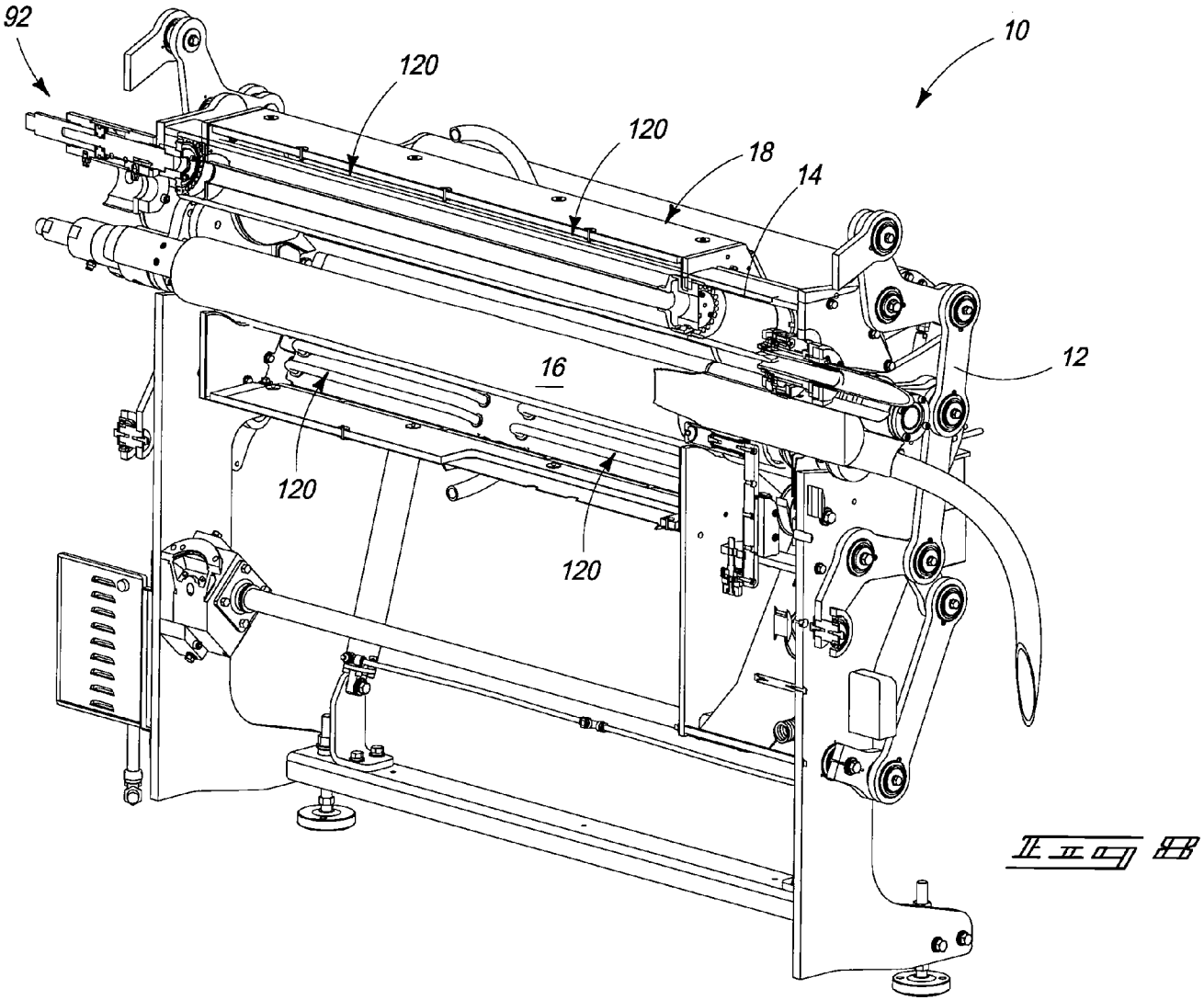
FIG. 8 is a vertical sectional perspective view of the rim rolling machine of FIG. 1 illustrating a top-most rim roller screw in vertical centerline sectional view.

FIG. 8 is a vertical sectional perspective view of the rim rolling machine of FIG. 1 illustrating a top-most rim rolling screw in vertical centerline sectional view. Resistive heating element assemblies 120 are shown within oven 18 in relation to screws 14 and 16.

Figure 9:
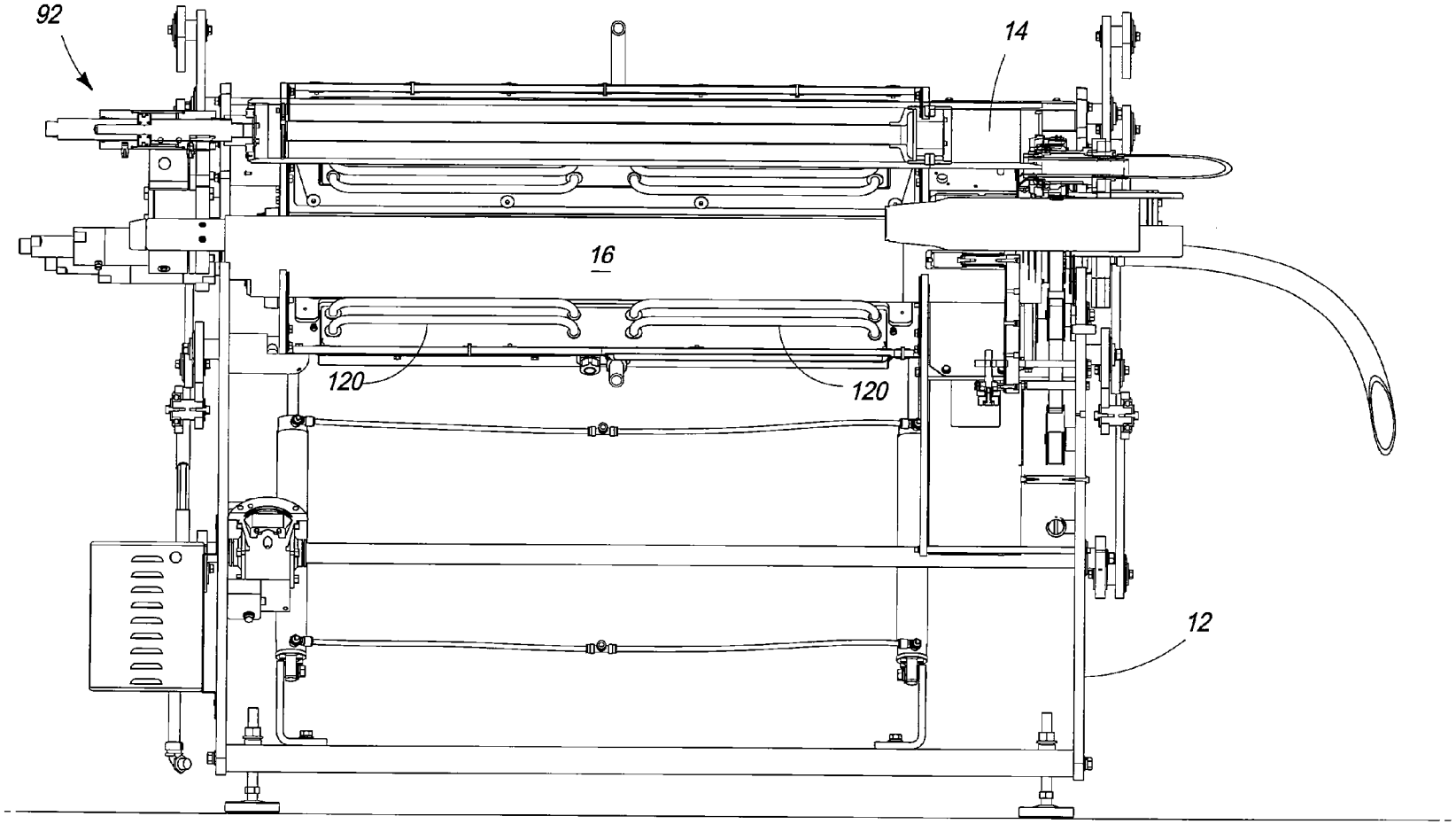
FIG. 9 is a frontal vertical sectional view of the rim rolling machine of FIG. 8.

FIG. 9 is a frontal vertical sectional of the rim rolling machine of FIG. 8. Arrangement of resistive heating elements 120 are shown in relation to screws 14 and 16.

FIG. 10 is a component perspective view of a screw exit pulley drive assembly 50. Drive assembly 50 includes belt drive pulley 56 and end plate 58. End plate 58 has an enlarged frustoconical bump 59. A complementary surface is formed in the beveled end of tube 40 in order to align the screw against end plate 58.

Figure 11:
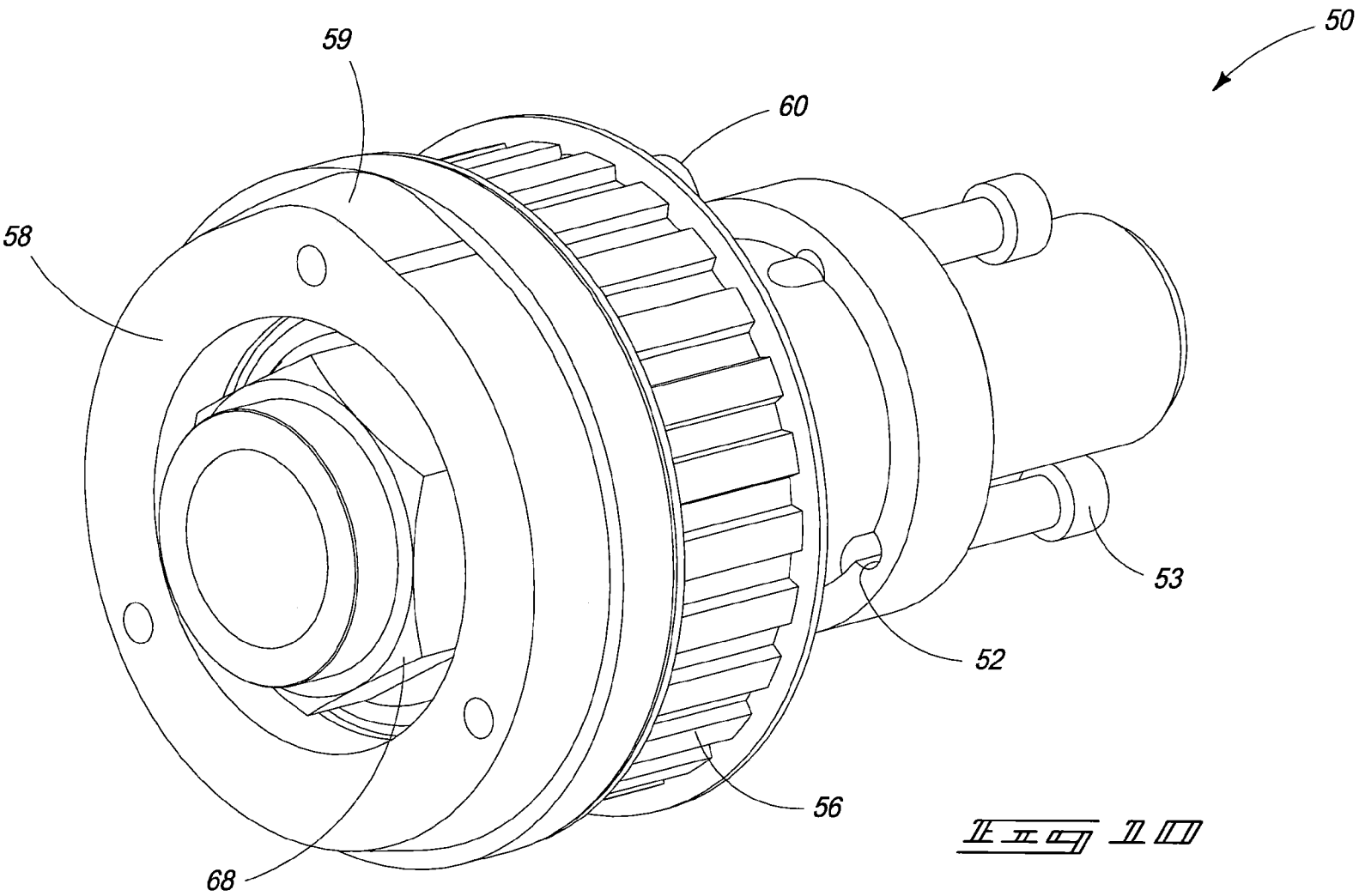
FIG. 11 is a screw drive assembly for driving three screw exit pulley assemblies of FIG. 10.
Figure 11:
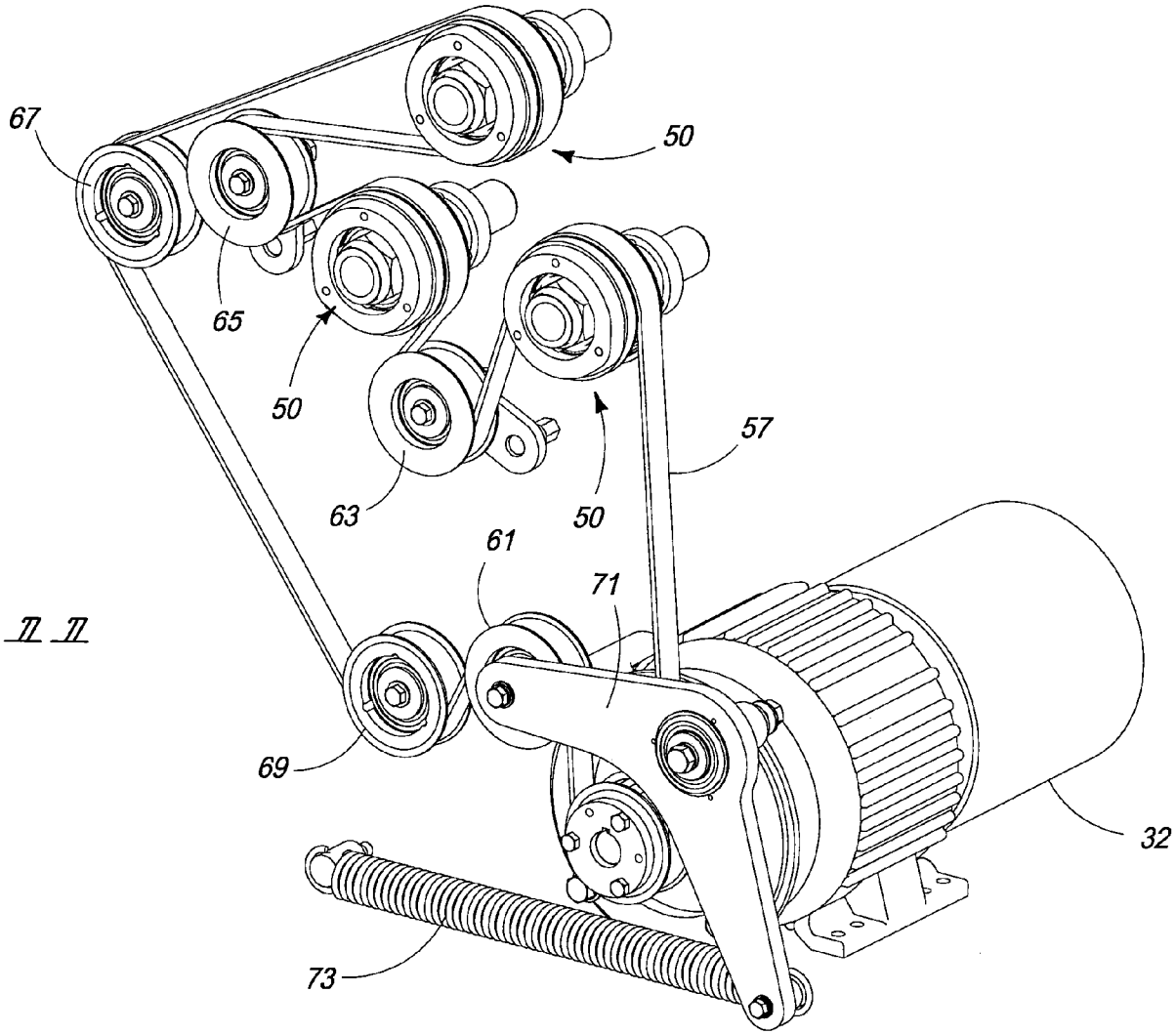

FIG. 11 is a screw drive assembly for driving three screw exit pulley assemblies of FIG. 10. The drive assemblies 50 for each of the three screws are shown being driven via a serpentine belt 57 that is driven by motor 32. Idler wheels, 61, 63, 65 cooperate with turning wheel 67 and 69 to drive assemblies 50 all in the same rotational direction (thereby driving the respective screws). A tensioning arm 71 is tensioned by a stretched coil spring 73.

FIG. 12 is an exit end perspective view, taken from the front, corresponding with that depicted in FIG. 1, with portions removed, showing a radial adjustment mechanism for radially adjusting position of the three rim rolling screws. A radial adjustment linkage 122 is shown for radially adjusting in and out one end of the screws.

Figure 12A:
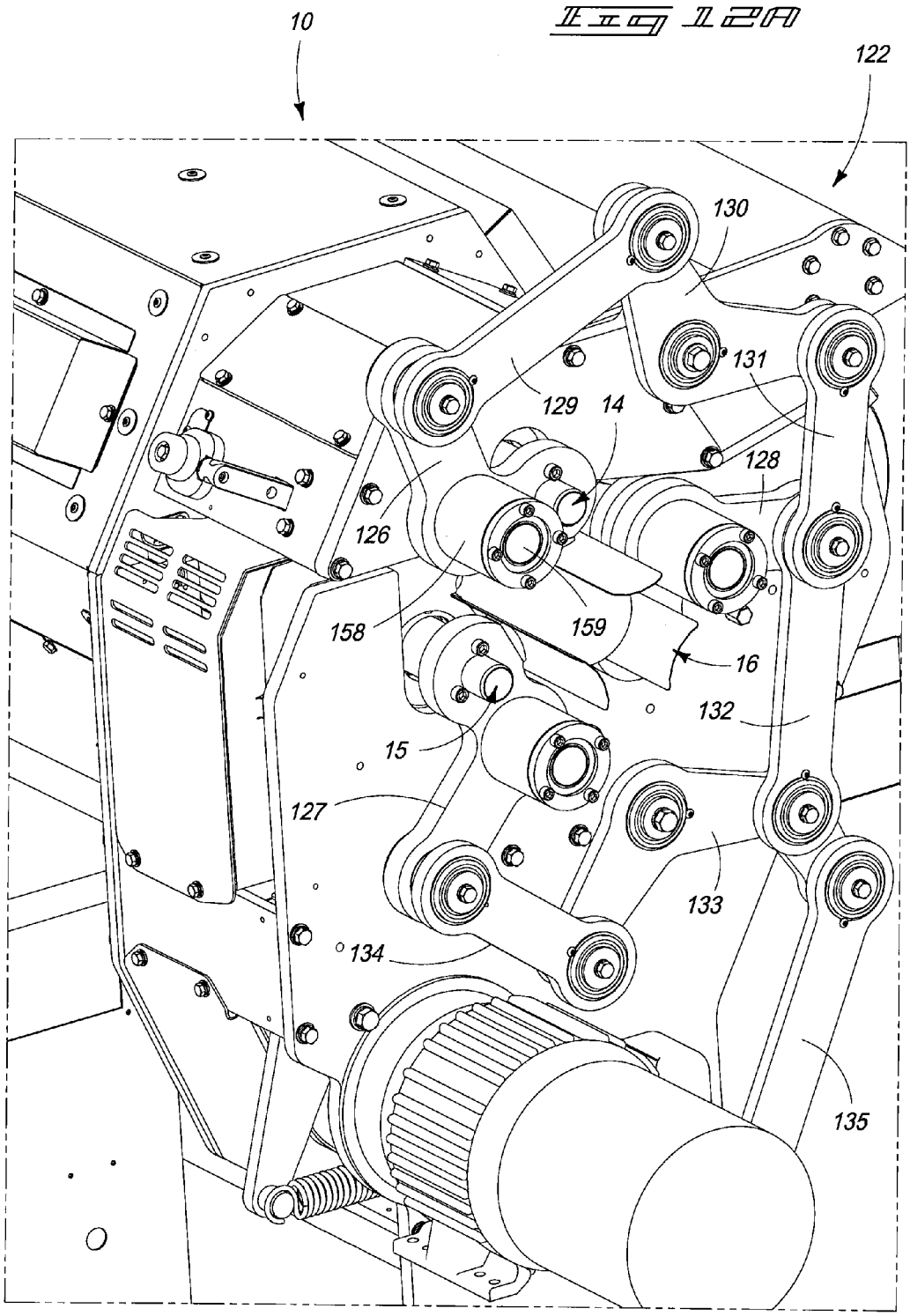
FIG. 12A is an enlarged partial perspective view of the radial adjustment mechanism of FIG. 12.

FIG. 12A is an enlarged partial perspective view of the radial adjustment mechanism of FIG. 12. Further details are shown for the radial adjustment linkage assembly 122. More particularly, linkage assembly 122 comprises a plurality of individual linkages 126-135, each joined together for pivotal motion with a rotary bearing assembly. Linkages 126-128 each comprise an L-shaped screw toggle bracket that has a bearing housing 158 that seats with a pair of cylindrical bearings for pivotal movement about a stationary post, or stump shaft 159 that is affixed to a frame member, or side plate of machine 10. An upper motion toggle bracket 130 and a lower motion toggle bracket 133 couple together linkages 126-128 via connecting linkages 129, A 131, 132 and 134. Toggle bracket 130 has a central pivot connection that mates with a cylindrical bearing to a frame of machine 10. Toggle bracket 133 has four pivotal connections and has a U-shaped configuration with a second pivotal connection coupled for pivotal motion to a frame of machine 10. A fourth connection of linkage 133 is pivotally coupled with a bearing to a common shaft linkage 135 that is affixed at an opposite end to a longitudinal shaft (not shown) that extends to an opposite end of machine 10 and pivotally couples with an adjustable common shaft linkage 155 (see FIG. 13A) of a similar linkage 122' that radially adjust an opposite end of each screw 14-16.

FIG. 13 is an exit end perspective view, taken from the rear, with portions removed, showing the radial adjustment mechanism of FIGS. 12-12A. A radial adjustment linkage assembly 122' is shown at an opposite end of the rim rolling apparatus 10 for radially adjusting in sequence an opposite end of each screw.

Figure 13A:
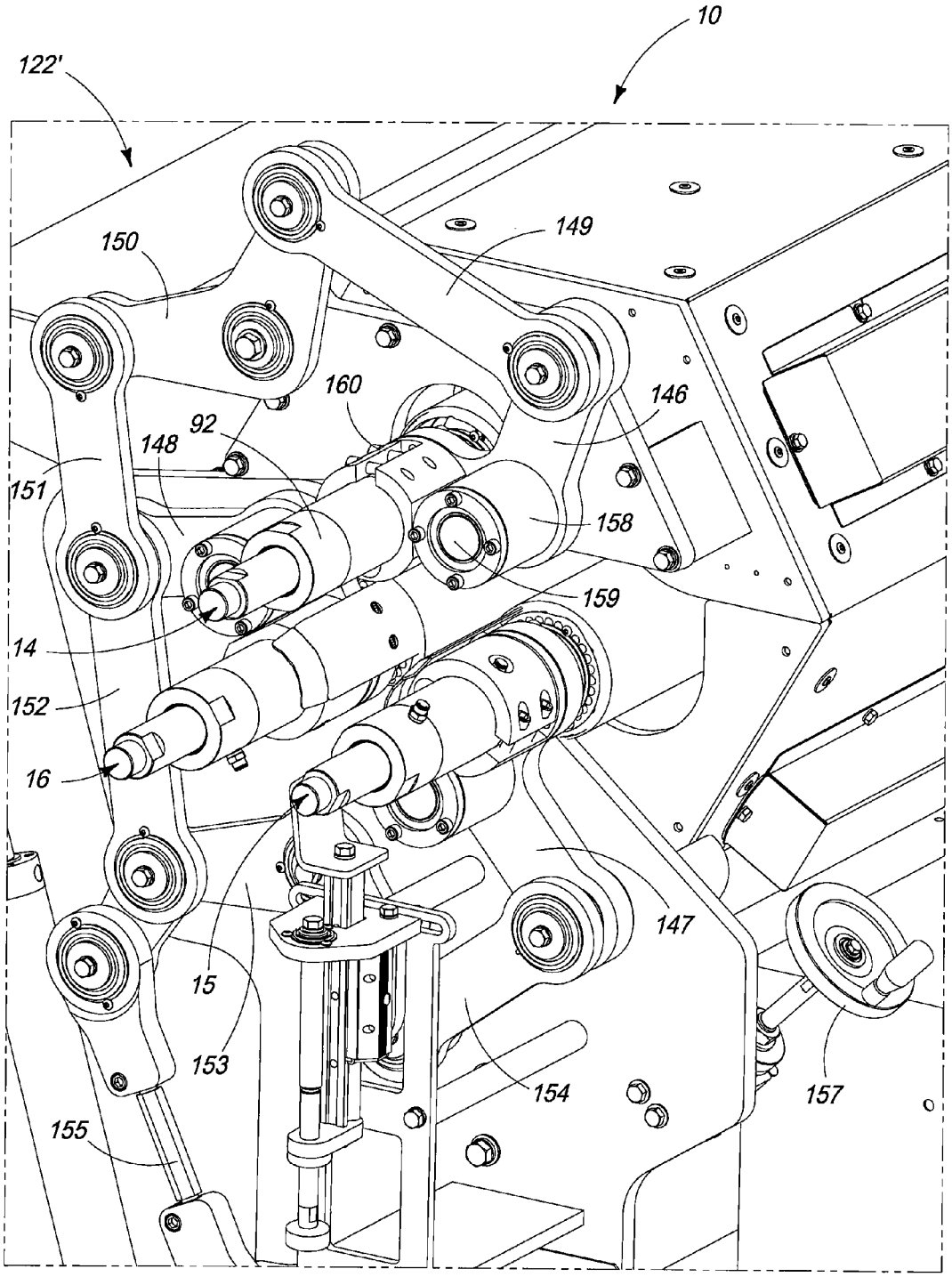
FIG. 13A is an enlarged partial perspective view of the radial adjustment mechanism of FIG. 13.

FIG. 13A is an enlarged partial perspective view of the radial adjustment mechanism of FIG. 13. The radial adjustment linkage 122' is shown in enlarged greater detail for radial adjusting screws 14-16 to accommodate different sized articles during a lip rolling operation. More particularly, linkage assembly 122' comprises a plurality of individual linkages 146-148, each joined together for pivotal motion with a rotary bearing assembly. Linkages 146-148 each comprise an L-shaped screw toggle bracket that has a bearing housing 158 that seats with a pair of cylindrical bearings for pivotal movement about a stationary post, or stump shaft 159 that is affixed to a frame member, or side plate of machine 10. An upper motion toggle bracket 150 and a lower motion toggle bracket 153 couple together linkages 146-148 via connecting linkages 149, 151, 152 and 154. Toggle bracket 150 has a central pivot connection that mates with a cylindrical bearing to a frame of machine 10. Toggle bracket 153 has four pivotal connections and has a U-shaped configuration with a second pivotal connection coupled for pivotal motion to a frame of machine 10. A fourth connection of linkage 153 is pivotally coupled with a bearing to an adjustable length common shaft linkage 155 that is affixed at an opposite end to a longitudinal shaft (not shown) that extends to an opposite end of machine 10 and pivotally couples with adjustable common shaft linkage 135 (see FIG. 12A) of a similar linkage 122 that radially adjust an opposite end of each screw 14-16. A rotary hand crank 157 and gearbox (not shown) rotate the longitudinal shaft that pivots linkages 135 (see FIG. 12A) and 155 (see FIG. 13A).

A clamp collar 160 is affixed onto one arm of linkage 146 (as well as on linkages 147 and 148) using threaded fasteners (or alternatively by welding). Clamp collar 160 has a cylindrical bore that receives a respective pneumatic cylinder 92 for mounting and removing tubes of each screw 14-16 by extending and retracting cylinder 92 by controlling delivery of a pneumatic source, such as an air supply line. Pneumatic cylinder 92 provides a set pressure when trapping tubes of each screw 14-16 and acts like a spring, enabling for thermal expansion and contraction of each tube caused by heating during operation in an oven. If a hydraulic cylinder was used, undue axial loads are placed on each bearing of screws 14-16, leading to premature bearing failure. According to one construction, pneumatic cylinder 92 is an SMC double rod pneumatic cylinder, Model No. NCGWBN63-0200-DUM01488, sold by SMC 10100 SMC Blvd., Noblesville, Ind. 46060.

Figure 14:
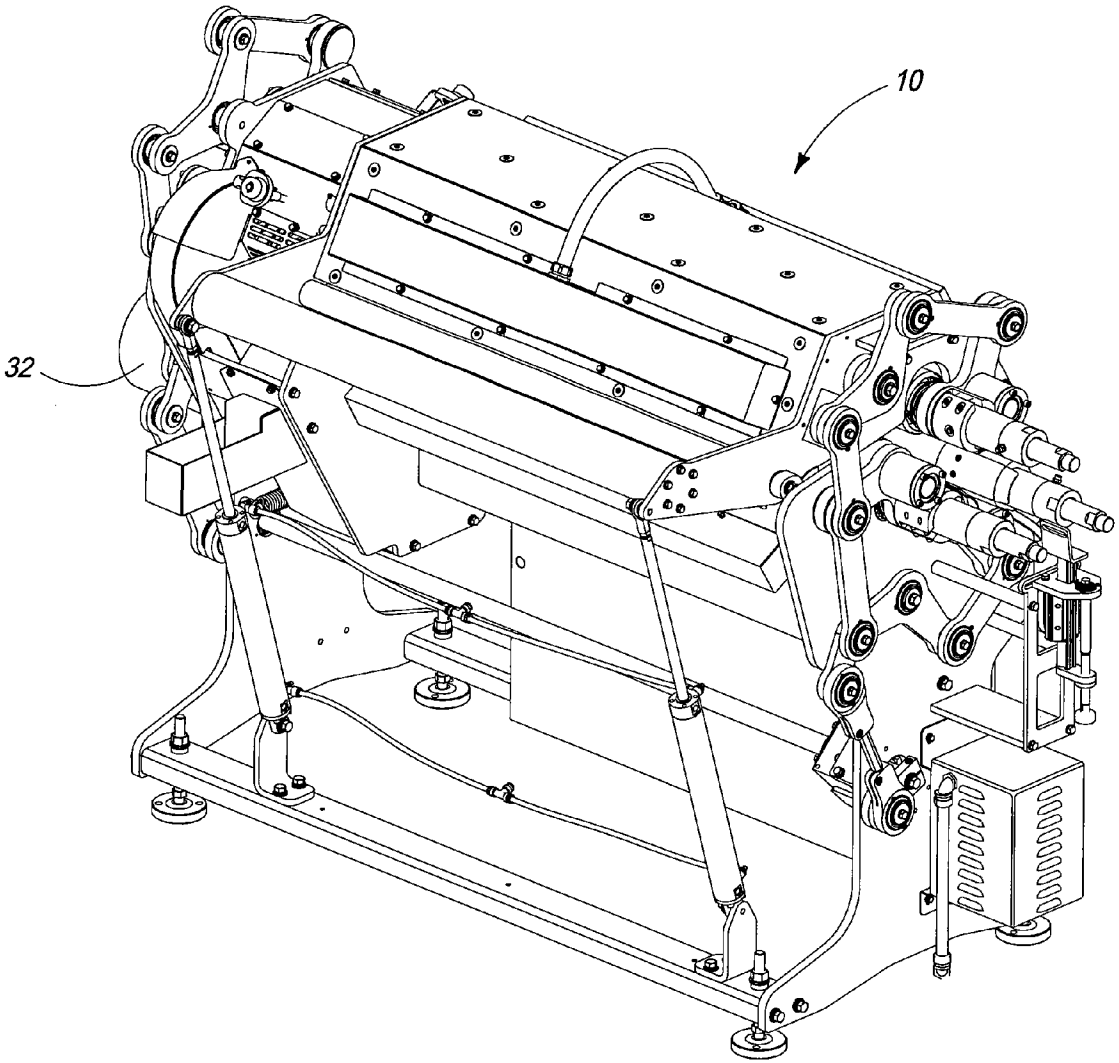
FIG. 14 is an entrance end perspective view, taken from the rear of the rim rolling machine of FIGS. 1-14.

FIG. 14 is an entrance end perspective view, taken from the rear of the rim rolling machine of FIGS. 1-14. Rim rolling apparatus 10 is shown with components omitted for clarity.

Figure 15:
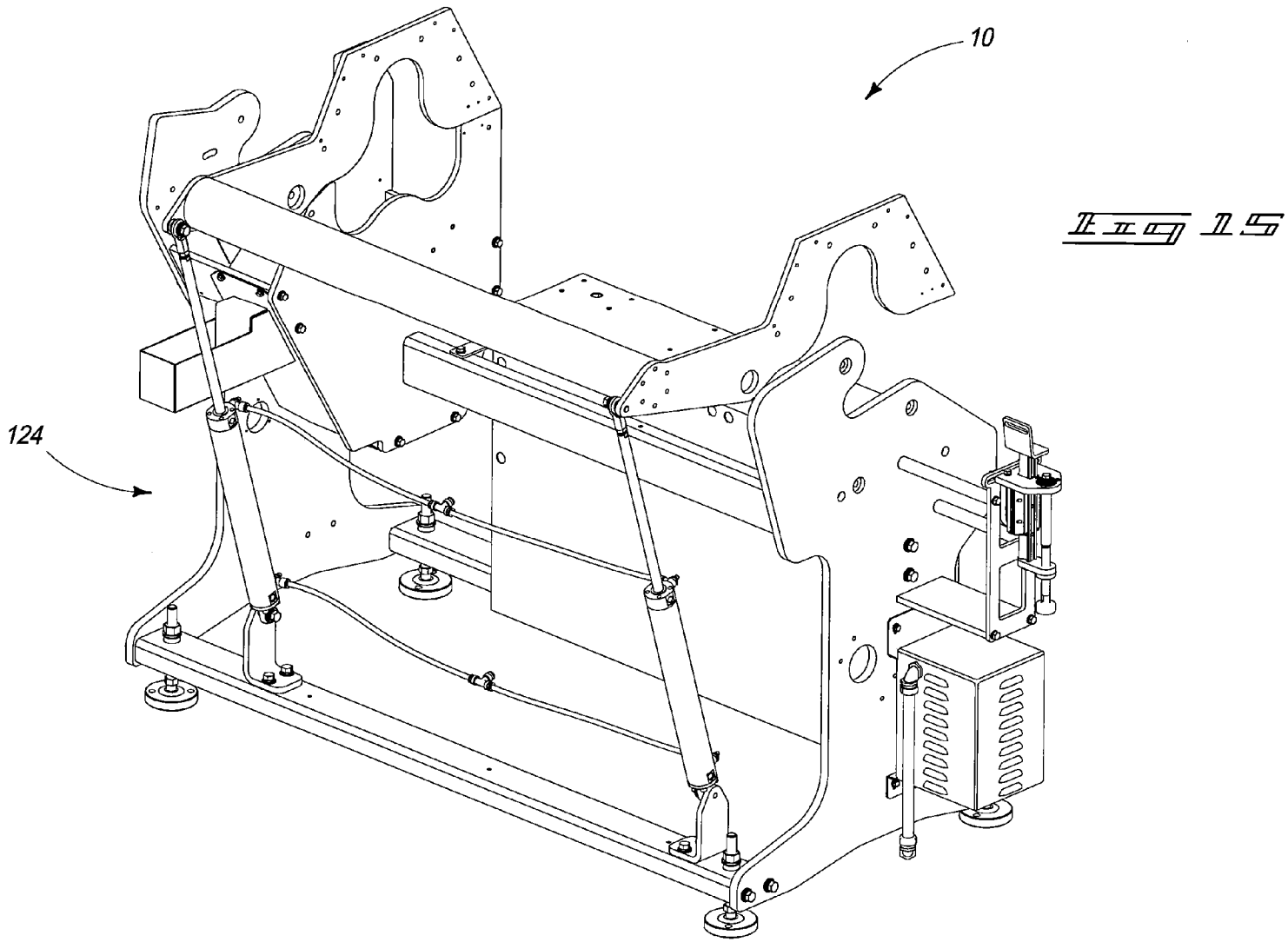
FIG. 15 is a perspective view corresponding with that shown in FIG. 14 showing details of the frame and oven cover opening mechanism shown in a closed position.

FIG. 15 is a perspective view corresponding with that shown in FIG. 14 showing details of the frame and oven cover opening mechanism shown in a closed position. A cover lift mechanism 124 is depicted on rim rolling apparatus 10.

Figure 16:
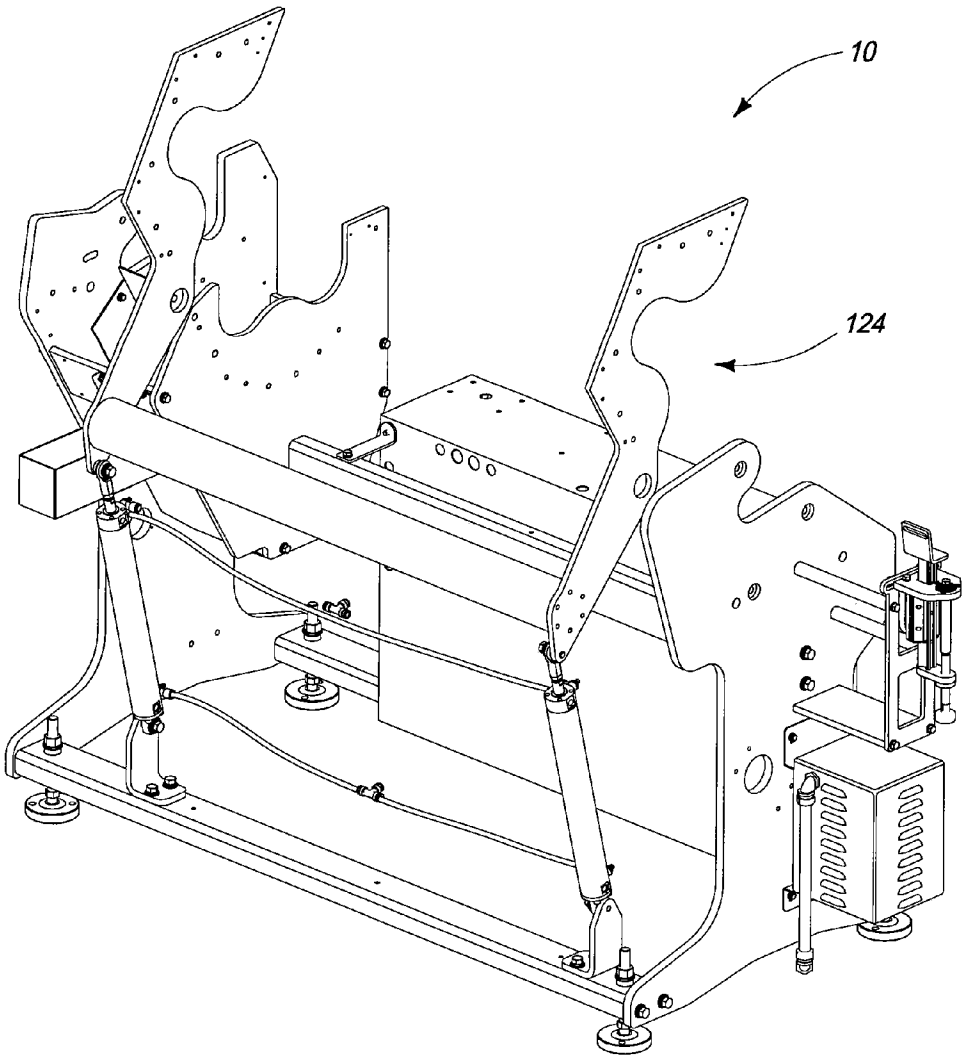
FIG. 16 is a perspective view of the rim rolling machine of FIG. 15 showing details of the frame and oven cover opening mechanism shown in an open position.
Figure 11:
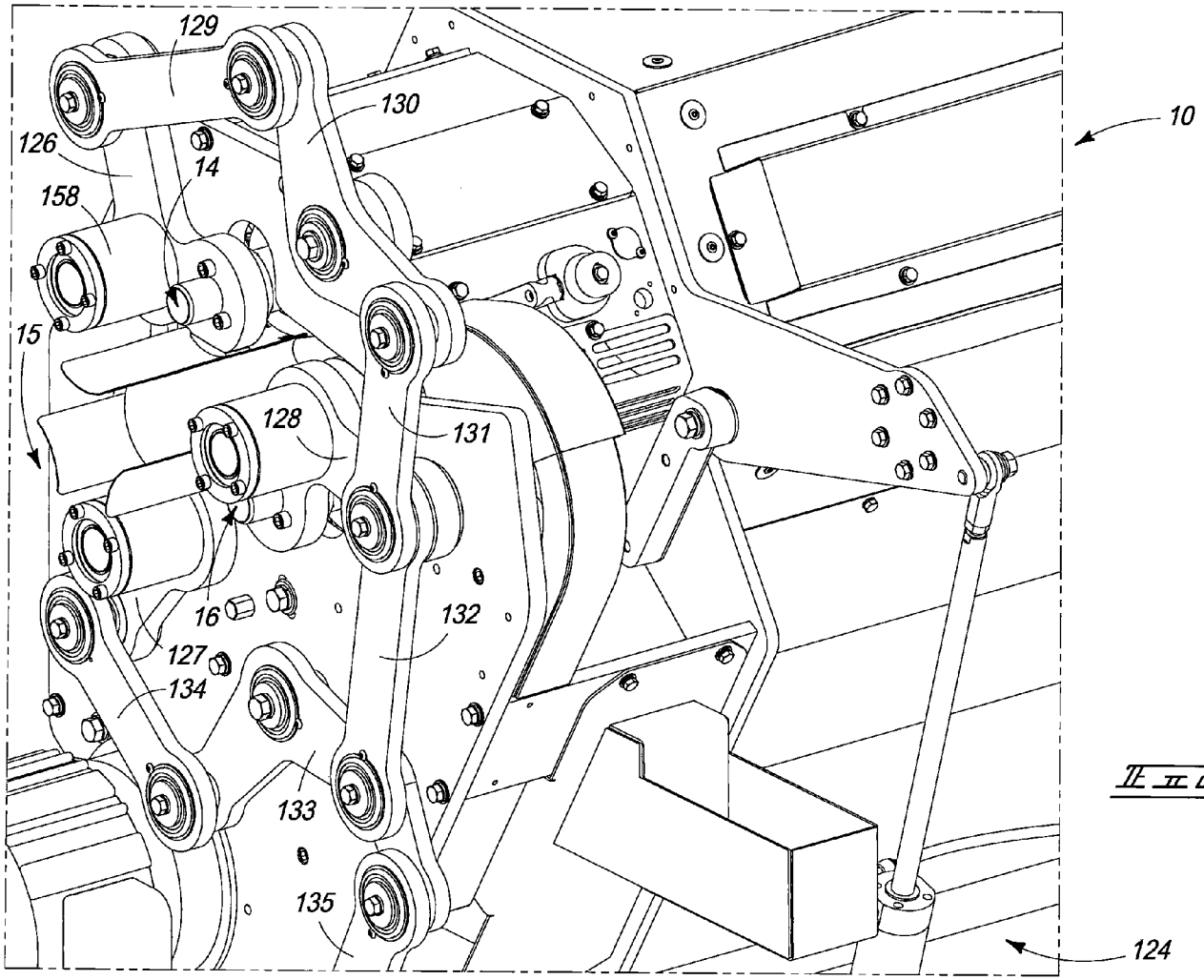

FIG. 16 is a perspective view of the rim rolling machine of FIG. 15 showing details of the frame and oven cover opening mechanism shown in an open position. Details of the cover lift mechanism (with other portions omitted) are shown in a lifted configuration for lifting a cover on the oven to access internal components, such as the screws contained therein.

FIG. 17 is an enlarged partial perspective view along an exit end from the rear of the rim rolling machine of FIGS. 1-16 showing portions of the oven cover opening mechanism. Further details are shown for the cover lift mechanism 124.

Figure 18:
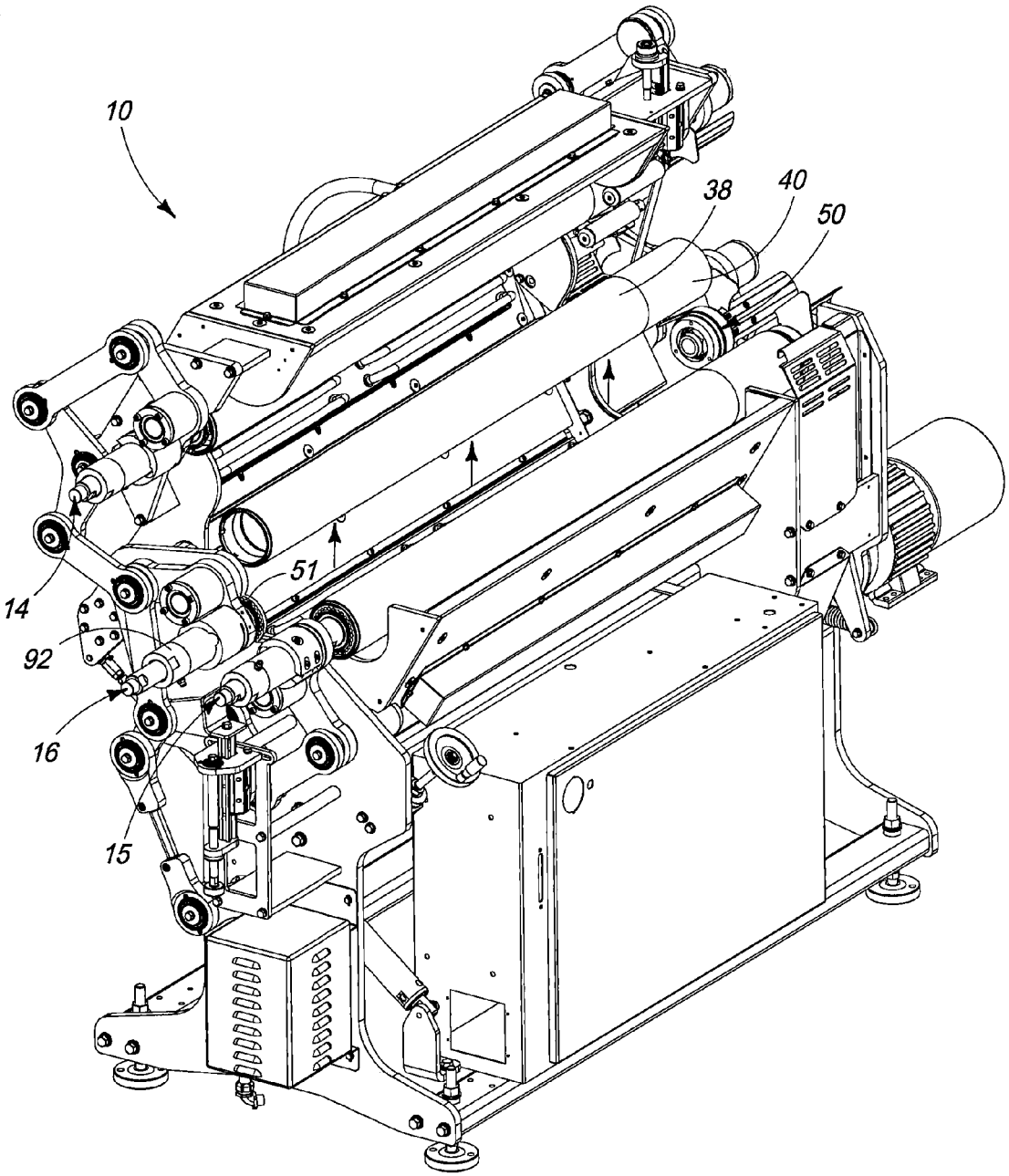
FIG. 18 is an exit end perspective view, taken from the rear, with cover portions removed, showing a mechanism for inserting and removing rim roller screws from the rim rolling machine.
Figure 11:
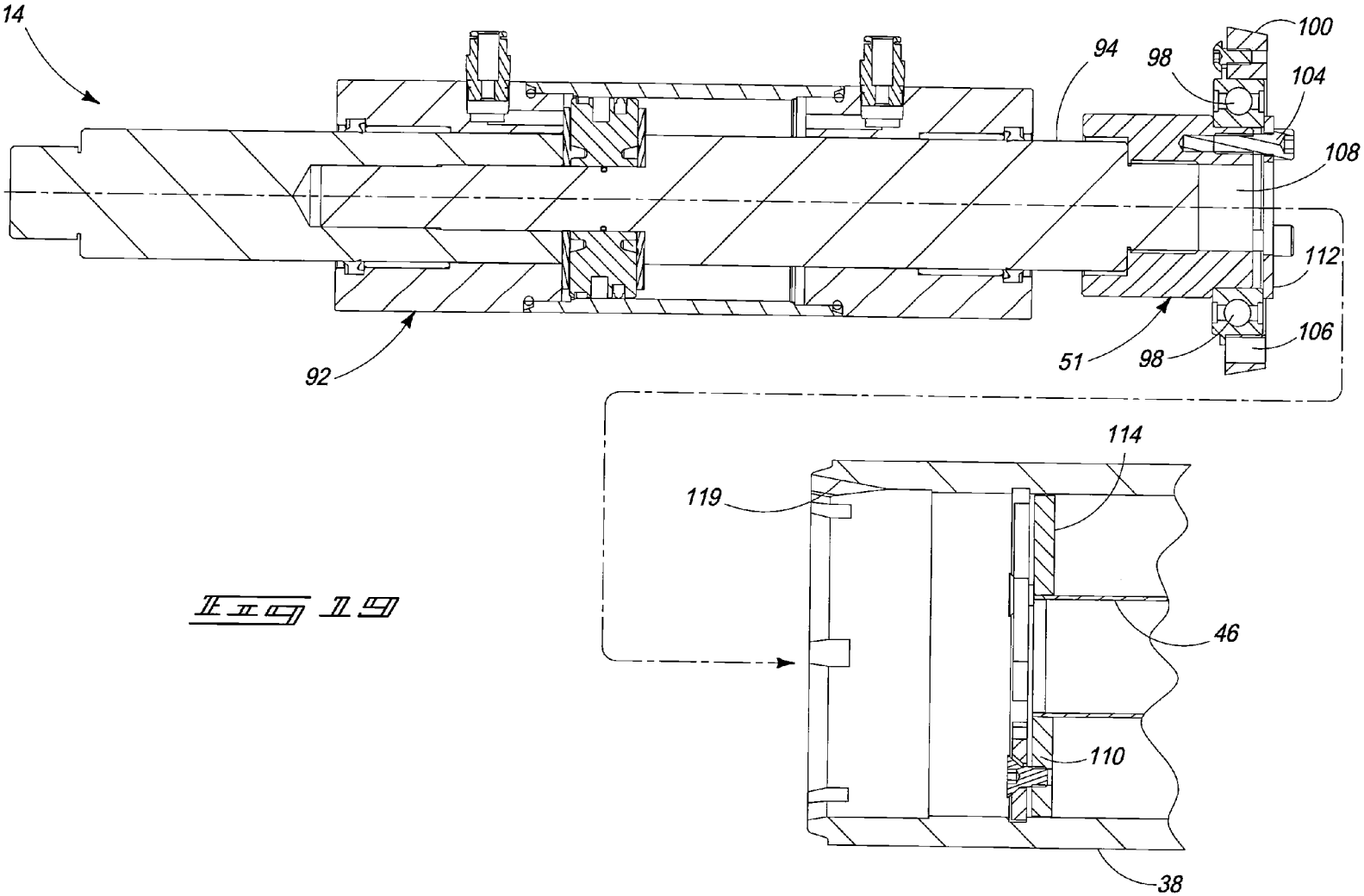

FIG. 18 is an exit end perspective view of rim rolling machine 10 opened up to show screw tubes 38, 40 of screw assembly 16 being removed during maintenance and/or when changing the screw roll. As shown in FIG. 18, pneumatic piston 16 has been retracted so as to move apart bearing assembly 51 from drive assembly 50, thereby freeing tubes 38 and 40 (as a single assembly) for removal from machine 10. Screw assemblies 14 and 15 operate in a similar manner to enable insertion and removal of the respective tube assemblies of each screw.

Figure 20:
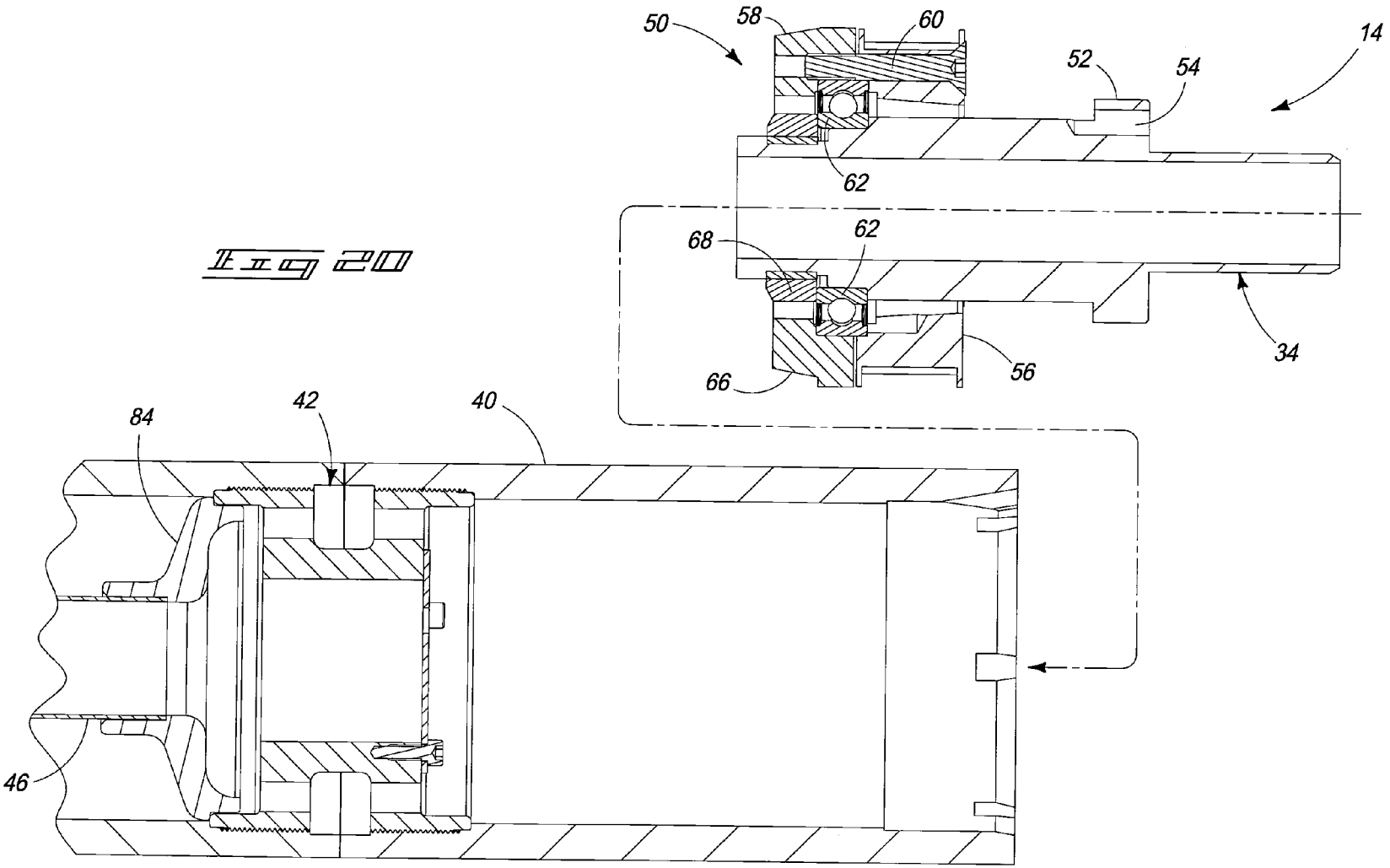
FIG. 20 is an entrance end view of a selected tube assembly for a rim roller screw.

FIG. 19 shows the manner in which pneumatic cylinder 92 connects to bearing assembly 51. More particularly, a distal end of piston 94 is threaded into a complementary bore within bearing assembly 51. Bearing assembly 51 includes a sealed deep groove steel ball bearing 98 that is received in an entrance end plate 100. A circumferential outer bevel on plate 100 mates with a complementary bevel within tube 38 as pneumatic pressure is applied in assembly using piston 92, thereby positively seating tube 38. This pressure also seats tube 40 (of FIG. 20) with complementary bevels on an exit end plate 58 during assembly. Piston 92 and drive assembly 50 are fixed on to a frame at spaced apart locations (namely, between respective brackets 126, 146; 128, 148; and 127, 147). Piston 92 provides a pneumatic spring that applies a steady pressure, even when tubes 38 and 40 lengthen as a result of thermal expansion in an oven. In contrast, if a hydraulic actuator or mechanically-fixed actuator or mount is used, undue stress is applied axially to the inner bearing races, which would lead to premature failure of bearings 62 and 98.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A rim rolling apparatus, comprising:

a plurality of rim rolling screws, each screw having an entrance end cylindrical tube providing a hot section and an exit end cylindrical tube providing a cool section downstream of the hot section;

a thermal isolation tube coupling together the entrance end tube and the exit end cylindrical tube in proximate, spaced-apart relation having a first coupling cylindrical outer surface configured to mate with a complementary surface on the entrance end cylindrical tube and a second coupling cylindrical outer surface configured to mated with a complementary surface on the exit end cylindrical tube, the first coupling cylindrical outer surface and the second coupling cylindrical outer surface provided on respective, spaced-apart circumferential bulkheads and a cooling gap interposed between the first coupling outer surface and the second coupling outer surface to provide thermal isolation there between;

a motor for driving the screws; and a pneumatic cooling circuit extending within the screw from an exit end towards an entrance end, the cooling circuit provided in thermally conductive relation with the cool section and insulated from the hot section and further communicating with the cooling gap of the thermal isolation tube.

2. The rim rolling apparatus of claim 1, further comprising a rotational bearing for supporting one end of the screw, the cooling circuit provided in thermally conductive relation with the bearing to cool the bearing.

3. The rim rolling apparatus of claim 1, wherein a rotational bearing is provided at each end of the screw, and the cooling circuit passes in thermally conductive relation proximate each bearing to cool the bearing from heat being generated by an oven in which the screw is being operated.

4. The rim rolling apparatus of claim 1, wherein the first coupling cylindrical outer surface on the thermal isolation tube comprises a threaded cylindrical outer surface and the complementary surface on the entrance end cylindrical tube comprises a complementary threaded cylindrical surface.

5. The rim rolling apparatus of claim 1, wherein the second coupling cylindrical outer surface on the thermal isolation tube comprises a threaded cylindrical outer surface and the complementary surface on the exit end cylindrical tube comprises a complementary threaded cylindrical surface.

6. The rim rolling apparatus of claim 1, wherein the thermal isolation tube further comprises a cylindrical central hub interposed between the spaced-apart circumferential bulkheads.

7. The rim rolling apparatus of claim 6, further comprising a circumferential array of bores extending through each of the bulkheads communicating with the circumferential gap and providing a portion of the pneumatic cooling circuit.

8. The rim rolling apparatus of claim 7, wherein the thermal isolation tube includes a central bore, and further including a baffle plate provided over the central bore having a plurality of flow limiting bores sized to encourage flow of cooling air through the pair of circumferential arrays of bores in the respective bulkheads.

9. The rim rolling apparatus of claim 1, further comprising a flow isolation tube supported coaxially within the entrance end cylindrical tube communicating with the thermal isolation tube and providing a portion of the pneumatic cooling circuit.

10. A rim rolling apparatus, comprising:

a plurality of rim rolling screws, each screw having an entrance end tube providing a hot section and an exit end tube providing a cool section downstream of the hot section;

a thermal isolation tube coupling together the entrance end tube and the exit end tube in proximate relation providing a gap there between and having a first coupling surface configured to mate with a complementary surface on the entrance end tube and a second coupling surface configured to mated with a complementary surface on the exit end tube, the first coupling surface and the second coupling surface provided on respective, spaced-apart portions of the thermal isolation tube and a cooling gap interposed between the first coupling surface and the second coupling surface to provide thermal isolation there between;

a motor for driving the screws; and a pneumatic cooling circuit extending within the screw from an exit end towards an entrance end, the cooling circuit provided in thermally conductive relation with the cool section and insulated from the hot section and further communicating with the cooling gap of the thermal isolation tube.

11. The rim rolling apparatus of claim 10, wherein the gap between the entrance end tube and the exit end tube comprises a cylindrical gap.

12. The rim rolling apparatus of claim 10, wherein the first coupling portion of the thermal isolation tube comprises a first thread portion and the second coupling portion of the thermal isolation tube comprises a second thread portion.

13. The rim rolling apparatus of claim 12, wherein the complementary portion on the entrance end tube and the complementary portion on the exit end tube each comprise a complementary third thread portion and fourth thread portion, respectively.

14. The rim rolling apparatus of claim 10, wherein the first coupling portion is thermally remote from the second coupling portion of the thermal isolation tube.

15. The rim rolling apparatus of claim 14, wherein a circumferential gap is provided between the first coupling portion and the second coupling portion in fluid communication with the pneumatic cooling circuit.

16. The rim rolling apparatus of claim 15, further comprising a circumferential array of bores extending through each of the spaced-apart portions of the thermal isolation tube communicating with the circumferential gap and providing a further portion of the pneumatic cooling circuit.

17. The rim rolling apparatus of claim 16, wherein the thermal isolation tube further comprises a cylindrical central hub interposed between the spaced-apart circumferential portions of the thermal isolation tube.

18. The rim rolling apparatus of claim 16, wherein the thermal isolation tube comprises a cylindrical central hub having a central bore, and further including a baffle plate provided over the central bore having a plurality of flow limiting bores sized to encourage flow of cooling air through the pair of circumferential arrays of bores in the respective spaced-apart portions of the thermal isolation tube.

19. The rim rolling apparatus of claim 10, further comprising a flow isolation tube supported coaxially within the entrance end cylindrical tube communicating with the thermal isolation tube and providing a portion of the pneumatic cooling circuit.

20. The rim rolling apparatus of claim 10, further comprising a rotational bearing for supporting one end of the screw, the cooling circuit provided in thermally conductive relation with the bearing to cool the bearing.

* * * * *